US010786914B2

(12) United States Patent
Galanis et al.

(10) Patent No.: US 10,786,914 B2
(45) Date of Patent: Sep. 29, 2020

(54) SHAVING CARTRIDGE INCLUDING A MASKING FOIL

(71) Applicant: Bic Violex S.A., Anixi (GR)

(72) Inventors: Christos Galanis, Agia Paraskevi (GR); Dimitrios Efthimiadis, Athens (GR); Christoforos-Athanasios Brellis, Neapoli (GR); Ioannis Malliaros, Athens (GR); Maria Petratou, Maroussi (GR); Anestis Tsegenidis, Maroussi (GR); Vasileios Papachristos, Zografou (GR)

(73) Assignee: BIC VIOLEX S.A., Anoixi (GR)

( * ) Notice: Subject to any disclaimer, the term of this patent is extended or adjusted under 35 U.S.C. 154(b) by 0 days.

(21) Appl. No.: 16/310,203

(22) PCT Filed: Jul. 27, 2017

(86) PCT No.: PCT/EP2017/069057
§ 371 (c)(1),
(2) Date: Dec. 14, 2018

(87) PCT Pub. No.: WO2018/019951
PCT Pub. Date: Feb. 1, 2018

(65) Prior Publication Data

US 2019/0255720 A1 Aug. 22, 2019

Related U.S. Application Data

(60) Provisional application No. 62/367,787, filed on Jul. 28, 2016.

(30) Foreign Application Priority Data

Jul. 28, 2016 (WO) ..... PCT/EP2016/068017

(51) Int. Cl.
*B26B 21/40* (2006.01)
*B26B 21/44* (2006.01)
*B26B 21/22* (2006.01)

(52) U.S. Cl.
CPC ..... *B26B 21/4006* (2013.01); *B26B 21/4037* (2013.01); *B26B 21/4068* (2013.01);
(Continued)

(58) Field of Classification Search
CPC ..... B26B 21/4006; B26B 21/4068; B26B 21/225; B26B 21/4031; B26B 21/4087; B26B 21/446; B26B 21/4037
See application file for complete search history.

(56) References Cited

U.S. PATENT DOCUMENTS 3,774,294 A * 11/1973 Michelson ..... B26B 21/40 29/432
4,211,006 A * 7/1980 Halaby ..... B26B 21/4006 205/122
(Continued)

FOREIGN PATENT DOCUMENTS

AT 007 252 U1 12/2004
FR 2 559 657 A1 12/1987
(Continued)

OTHER PUBLICATIONS

International Search Report dated Nov. 15, 2017, in International Application No. PCT/EP2017/069057 (4 pages).

*Primary Examiner* — Omar Flores Sanchez
(74) *Attorney, Agent, or Firm* — Bookoff McAndrews, PLLC

(57) ABSTRACT

A masking foil, for a shaving cartridge, and a shaving cartridge comprising a housing having a top surface, a bottom surface, a front edge, a rear edge, and a pair of side edges extending between the front edge and the rear edge. The housing includes a main blade disposed between the
(Continued)

front edge and the rear edge. The main blade includes a main cutting edge extending toward the top surface and is movable in the housing. The shaving cartridge further comprises a masking foil. The masking foil includes a front portion located forward of the main cutting edge, a back portion located rearward the main cutting edge, and at least one ribbon which extends between the front portion and the back portion and which partially covers the main cutting edge.

20 Claims, 29 Drawing Sheets

(52) U.S. Cl.
CPC ..... *B26B 21/44* (2013.01); *B26B 21/225* (2013.01); *B26B 21/4031* (2013.01); *B26B 21/4087* (2013.01); *B26B 21/446* (2013.01)

(56) References Cited

U.S. PATENT DOCUMENTS 4,914,817 A * 4/1990 Galligan ..... B26B 21/4006 30/346.58
4,985,995 A * 1/1991 Coffin ..... B26B 21/225 30/50
5,090,124 A * 2/1992 Althaus ..... B26B 21/4006 30/50
5,205,040 A * 4/1993 Werner ..... B26B 21/20 30/346.56
5,410,812 A * 5/1995 Althaus ..... B26B 21/4006 30/50
5,456,009 A * 10/1995 Wexler ..... B26B 21/22 30/77
5,493,778 A * 2/1996 Ichiyanagi ..... B26B 21/4006 30/41
5,560,105 A * 10/1996 Ichiyanagi ..... B26B 21/4006 30/77
5,579,580 A * 12/1996 Althaus ..... B26B 21/22 30/50
5,630,275 A * 5/1997 Wexler ..... B26B 21/22 30/346.53
D524,483 S 7/2006 Bunnell et al.
D526,089 S 8/2006 Fischer et al.
8,015,710 B1 9/2011 Zyla
10,369,713 B1 * 8/2019 Squires ..... B26B 21/227
2001/0054235 A1 12/2001 Saito
2004/0231161 A1 * 11/2004 Coffin ..... B26B 21/4006 30/50
2006/0032056 A1 * 2/2006 Coffin ..... B26B 21/14 30/50
2008/0250647 A1 * 10/2008 Fischer ..... B26B 21/222 30/50
2010/0024615 A1 2/2010 Rebaudieres et al.
2018/0071929 A1 * 3/2018 Walker, Jr. ..... B26B 21/222
2018/0368549 A1 * 12/2018 Mehaddene ..... A45D 26/0023
2019/0016001 A1 * 1/2019 Zucker ..... B26B 21/56
2019/0118397 A1 * 4/2019 Drori ..... B26B 21/4037

FOREIGN PATENT DOCUMENTS

FR 2599657 A1 12/1987
GB 2461337 A 1/2010
WO 97/33728 A1 9/1997
WO 0107214 A1 2/2001
WO 01/71214 A1 9/2001
WO 2007/147420 A1 12/2007
WO 2014/119808 A1 8/2014

* cited by examiner

FIG. 28
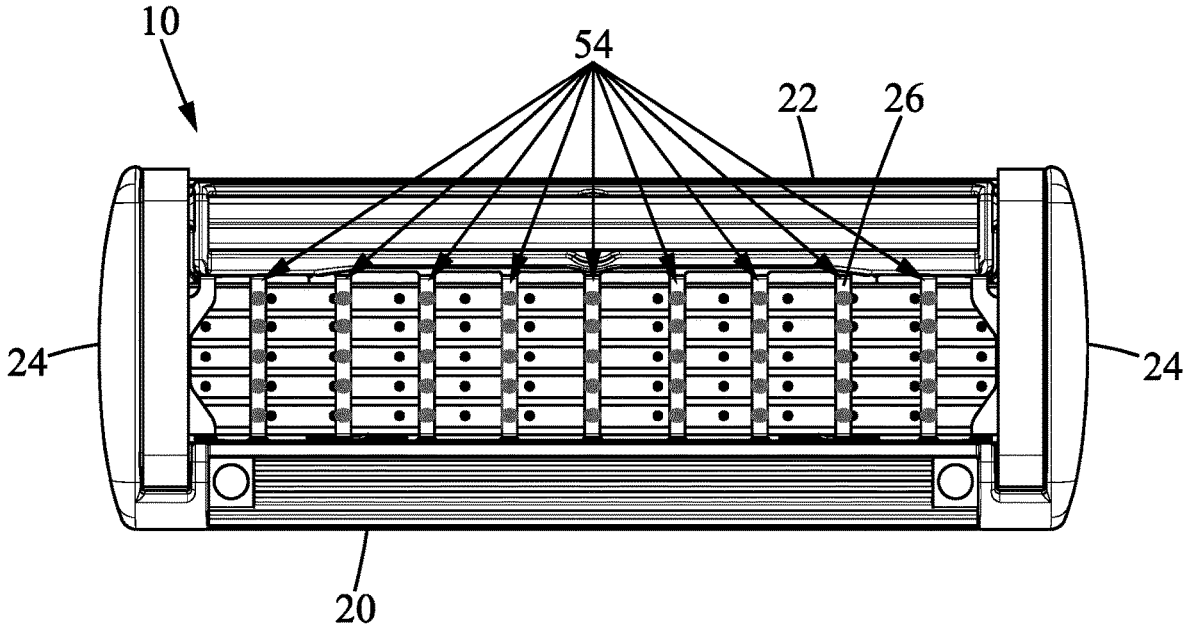
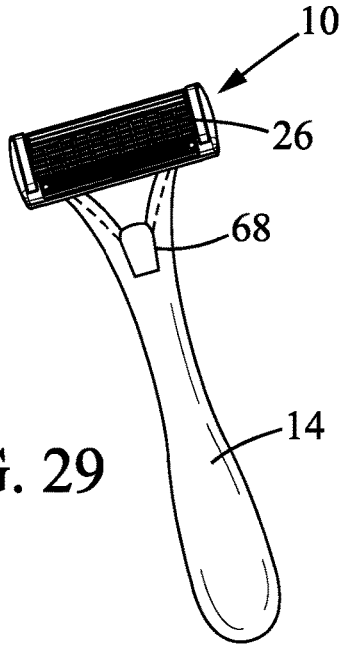
FIG. 29

SHAVING CARTRIDGE INCLUDING A MASKING FOIL

CROSS REFERENCE TO RELATED APPLICATION

This application is a National Stage application of International Application No. PCT/EP2017/069057, filed on Jul. 27, 2017, and published as WO2018/019951 on Feb. 1, 2018, which claims priority to International Application No. PCT/EP2016/068017, filed on Jul. 28, 2016, and U.S. Provisional Application No. 62/367,787, filed Jul. 28, 2016.

FIELD OF THE DISCLOSURE

The disclosure relates to shaving cartridges including a masking foil and such a masking foil. More particularly, the disclosure relates to shaving cartridges including a housing, one or more blade(s) having a blade edge and a masking foil or blade shield that partially covers the blade edge(s).

BACKGROUND OF THE DISCLOSURE

Generally, shaving cartridges typically include multiple guard members disposed across the razor blade edges. These members can act as blade shield to control the skin profile during shaving. However, this type of guard member is not satisfactory because assembly on a shaving cartridge is difficult and the shaving performance is not efficient enough. Furthermore, this type of guard member is not suitable to a shaving cartridge including movable blades.

Therefore, the known blade shields do not provide comfort and easy to glide movement in shaving while being easy to mount in a shaving cartridge with movable or unmovable blades.

SUMMARY OF THE DISCLOSURE

Accordingly, in examples, disclosed are shaving cartridges having a blade shield that provides added protection for the skin during shaving by improving the sliding surface in contact with the skin, while increasing comfort in shaving and glideness. The blade shield also provides a hair alignment that decreases the hair-cutting force.

To this end, according to the disclosure, the shaving cartridge may include a housing having a top surface, a bottom surface, a front edge, a rear edge, and a pair of side edges extending between the front edge and the rear edge, the housing having a main blade disposed between the front edge and the rear edge, the main blade having a main cutting edge extending toward the top surface, the main blade being movable in the housing, wherein the shaving cartridge may include a masking foil having a front portion located forward of the main cutting edge and a back portion located rearward the main cutting edge, the masking foil further including at least one ribbon which partially may cover the main cutting edge, wherein the main blade may be movable in the housing.

The shaving cartridge according to the disclosure may create a special skin sliding surface that may alter the skin flow before the cutting edge.

In various examples of the disclosure, one and/or the other of the following features may be incorporated in the shaving cartridge of the disclosure, alone or in mutual combination:

- the masking foil may include an elastic means. Therefore, the elastic means of the masking foil may allow to the masking foil to follow the movement of the movable blade.

- the masking foil may include at least one securing portion, the securing portion being placed on the main blade, toward the top surface and close to one of the pair of side edges. This securing portion of the masking foil is in position for proper assembly into the cartridge.
- at least one additional blade, the at least one additional blade having an additional cutting edge, wherein the at least one ribbon partially may cover both the main cutting edge and the at least one additional cutting edge, and wherein the securing portion may be placed on the main blade and the at least one additional blade, toward the top surface and close to one of the pair of side edges.
- the at least one ribbon partially may cover the main cutting edge and may uncover the at least one additional cutting edge.

In this way, the uncovered blade may increase shaving efficiency and the covered blade may alter the exposure of the subsequent uncovered blade. Therefore, the shaving cartridge may have two different shaving geometries. In other words, a first shaving geometry may correspond to the uncovered blade(s). A second shaving geometry may correspond to the covered blade(s).

- a blade retainer and the securing portion which may be disposed between the main blade and the blade retainer.
- the cartridge has a blade retainer including the securing portion of the masking foil.
- the securing portion may be fixedly mounted in the side edge of the shaving cartridge.
- the at least one ribbon includes a front bent portion connected to the front portion and a back bent portion connected to the back portion of the masking foil, the front and the back bent portion being directed toward the bottom surface. These bent portions provide a rigidity of the masking foil.
- the masking foil may include more than one ribbon, the front bent portions of each ribbon being connected to a front anchorage area, and the back bent portions of each ribbon being connected to a back anchorage area.
- when the masking foil includes an elastic means, this elastic means may be located between the anchorage area and at least one of the front or back bent portions of the ribbon. The anchorage area may also be fixed in the housing.
- the cutting edge coverage percentage of the at least one ribbon may be between 1% and 70%. More precisely, the coverage percentage may be between 5% and 20%.
- the shape of the surface of the at least one ribbon covering at least partially the main cutting edge may be planar, in a cross-sectional view.
- the at least one ribbon may cross the main cutting edge with an angle of between 15° and 90°. Thus, the ribbon may be perpendicular to the front portion and the back portion. The ribbon may also be oblique, converging, deflecting or curved with variable angles, which may change the interaction of the shaver head with the skin and may improve shaving comfort and reduce the skin friction. The above orientations may alter the way that the shaver head interacts with the skin, thus improving skin management and shaving comfort and reducing the head to skin friction. For example, diverging ribbons may further stress the skin, creating thus a smoother skin terrain with less friction.
- the at least one ribbon may cross the main cutting edge and at least one additional cutting edge with an angle of between 15° and 90°.

the masking foil can include a wound healing and/or an anti-bacterial agent, in order to enhance functionality of the masking foil. The masking foil can also include a lubricating coating, such as polyfluorocarbon. This coating may provide a reduction of the friction between the shaving cartridge and the skin.

the masking foil can further include a material chosen among steel, stainless steel, plastic material, composite, aluminum, aluminum alloys and/or noble metals chosen among the group consisting of gold, platinum and/or other metallic material.

the masking foil can include different shapes in a cross-sectional view.

the masking foil can include different patterns.

The shaving cartridge can include two masking foils.

Another object of the present disclosure may be a masking foil, for a shaving cartridge, having a front portion and a back portion and at least one ribbon extending between the front portion and the back portion, wherein the masking foil includes an elastic means.

Another object of the present disclosure may be a masking foil, for a shaving cartridge, manufactured by a method including the steps of: a) providing a flat strip of material, b) performing holes in the strip, c) forming the pattern of the masking foil; and d) forming a front bent portion and a back bent portion.

BRIEF DESCRIPTION OF THE DRAWINGS

Other characteristics and advantages will readily appear from the following description of one example, provided as non-limitative examples, in reference to the accompanying drawings.

FIGS. 13 to 43 are illustrations of other examples of masking foil.

In the different figures, the same reference signs designate identical or similar elements.

DETAILED DESCRIPTION OF THE DISCLOSURE

The Figures illustrate different examples of a shaving cartridge 10 according to the disclosure, the shaving cartridge 10 comprising one or several blades 12 provided in a housing 13. The blade(s) 12 may be movably retained in the housing 13. The shaving cartridge 10 can be permanently or detachably attached to a razor handle 14. The shaving cartridge 10 may be pivotally or non-pivotally attached to the razor handle 14.

Figure 1:
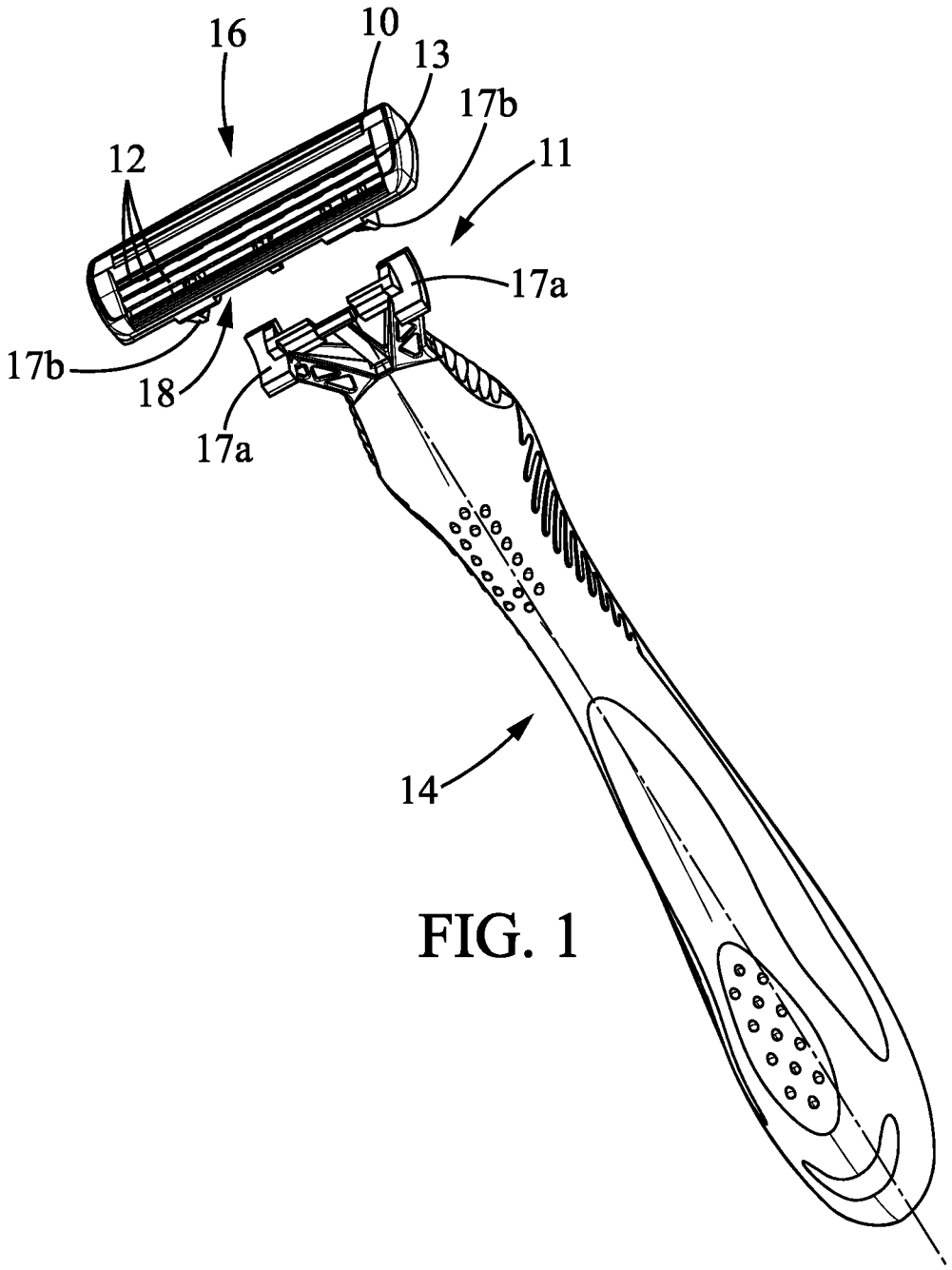
FIG. 1 is a perspective view of a wet shaving razor, including a shaving cartridge, according to the present disclosure.

For instance, as illustrated in FIG. 1, the shaving cartridge 10 according to the disclosure includes three blades 12, but the disclosure may not be limited to said number of blades. The number of blades may however vary between one and six blades for instance. The shaving cartridge 10 may be connected to the razor handle 14 to form a wet shaving razor 11. As depicted in FIG. 1, the shaving cartridge 10 may be detachably connected to the handle 14 in order to be thrown when the blade edges are dulled.

As shown in FIG. 1, the bottom surface 18 of the shaving cartridge 10 may include two connecting members or rearwardly protruding connectors, i.e. two inwardly facing arcuate arms 17*a* shaped in correspondence with and adapted to receive lateral edges of shell bearing 17*b* provided onto the handle 14 for pivotally mounting the shaving cartridge 10 onto the handle 14.

Figure 2:
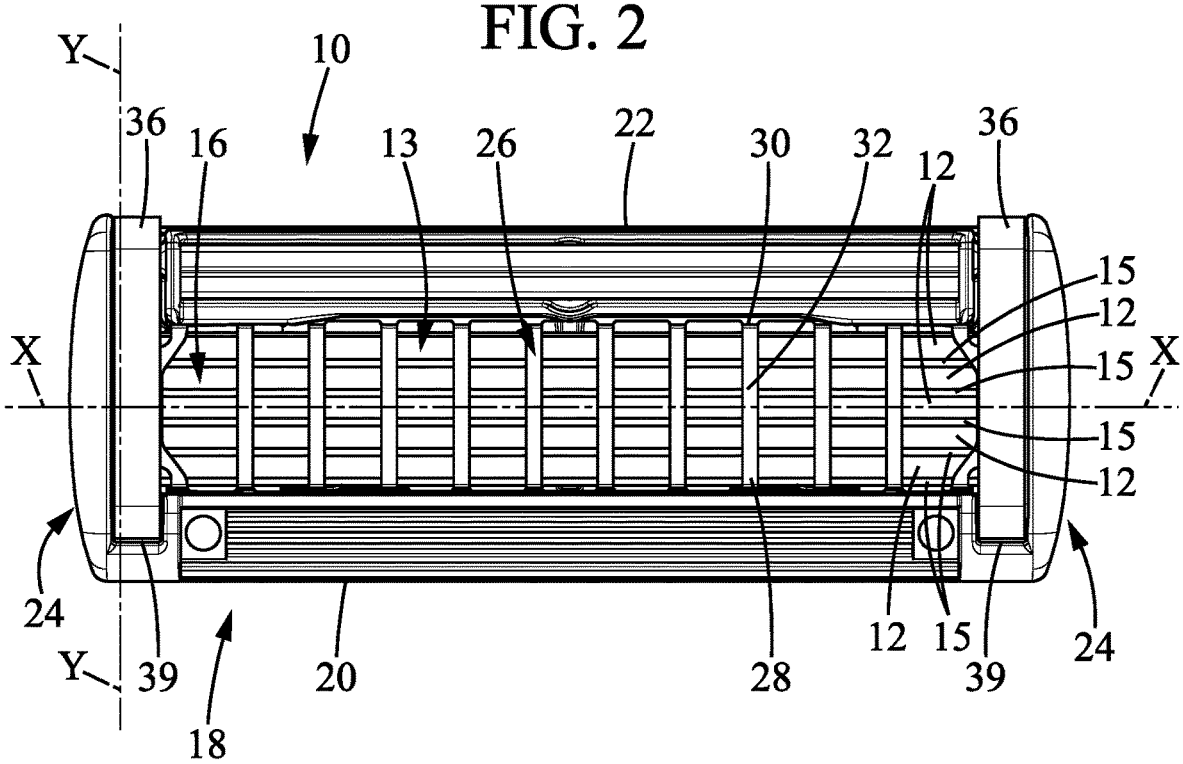
FIG. 2 is a top view of an example of the cartridge according to FIG. 1.
Figure 3:
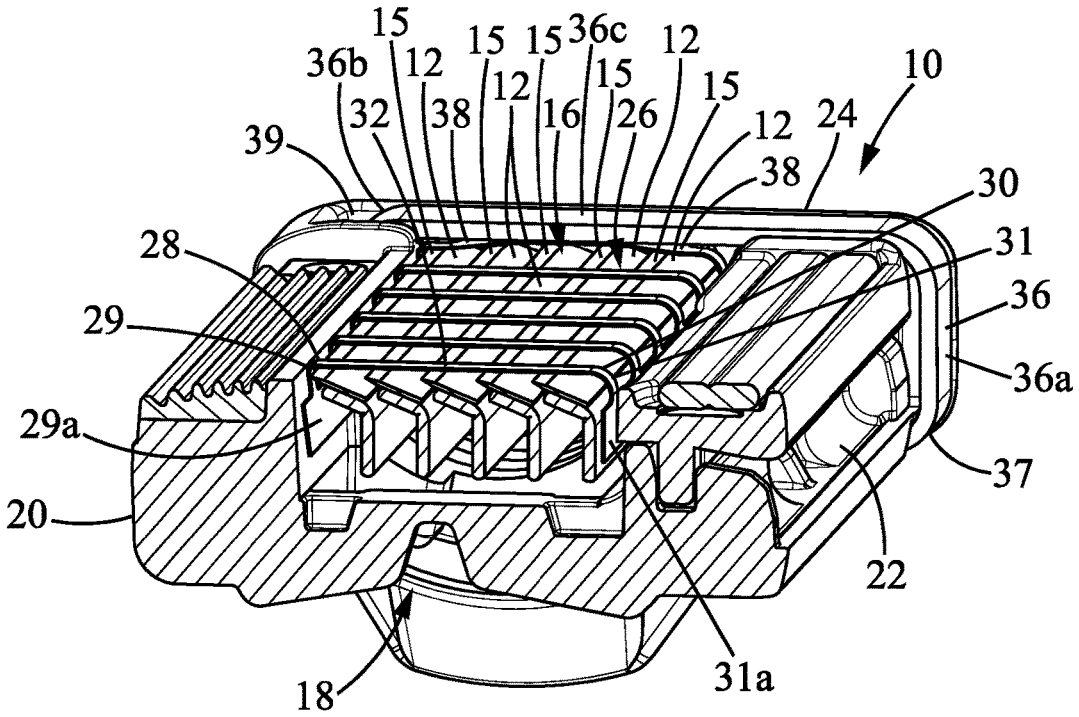
FIG. 3 is a cross-section in a perspective view of the cartridge of FIG. 2.

As best shown in FIGS. 2 and 3, the housing 13 may have a top surface 16, a bottom surface 18, a front edge 20, a rear edge 22, and a pair of side edges 24 extending between the front edge 20 and the rear edge 22. The housing 13 may include at least one blade 12 disposed between the front edge 20 and the rear edge 22. Each blade 12 may have a cutting edge 15 extending toward the top surface 16. The cutting edges 15 of the blades 12 can be parallel to an axis X-X.

Figure 4:
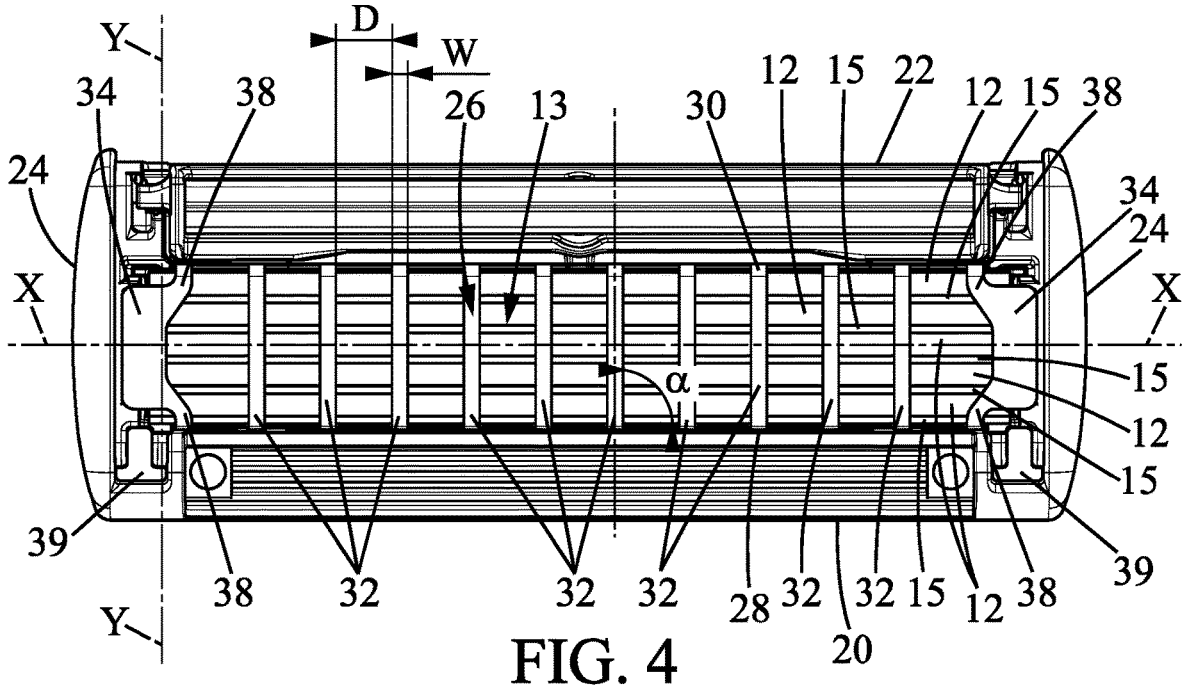
FIG. 4 is a top view illustrating an example of the securing portion of the cartridge of FIG. 2, the blade retainer being removed.

A masking foil 26 may cover partially the cutting edge 15 of one or more blade(s) 12. As depicted in FIGS. 3 and 4, the masking foil 26 may cover partially the cutting edge 15 of all the five blades 12.

Figure 5A:
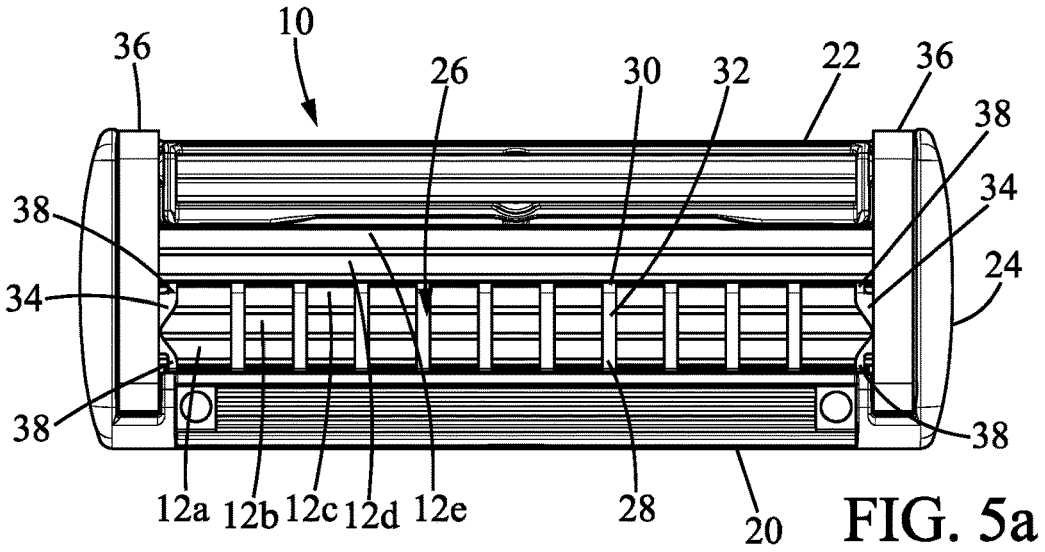
FIG. 5*a* is top view of another example of the shaving cartridge according to the disclosure.
Figure 6:
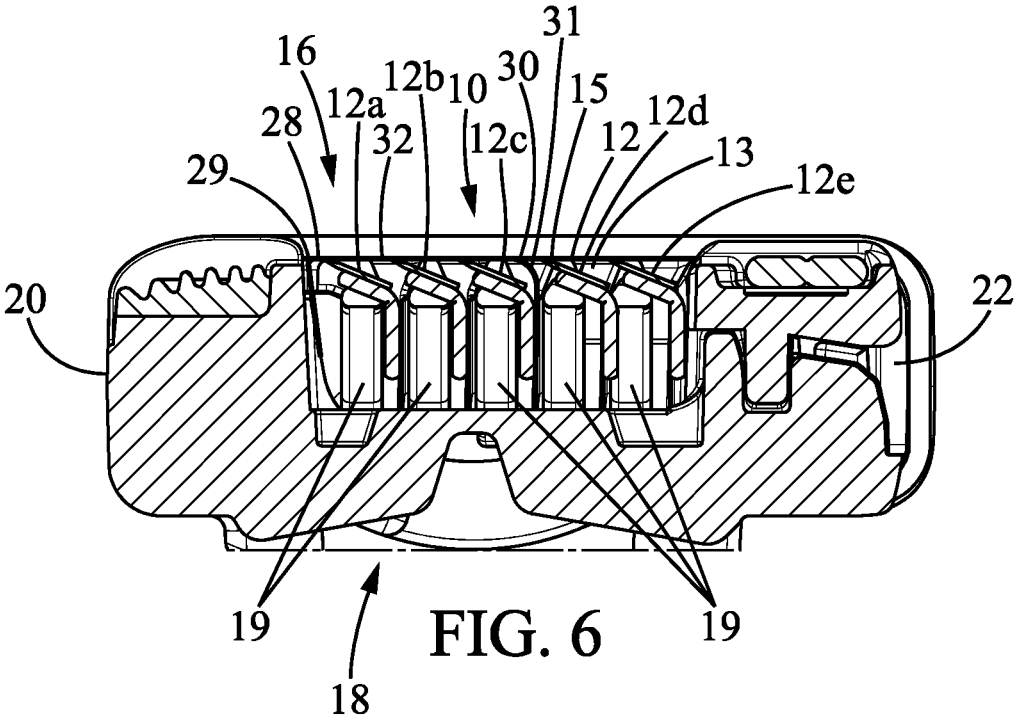
FIG. 6 is a cross-sectional view of the example of FIG. 5*a*.

In another example, as depicted in FIGS. 5*a* and 6, the masking foil may cover partially the cutting edge 15 of a main blade and at least one adjacent blade 12. In these Figures, illustrating a shaving cartridge comprising five blades 12, only three adjacent blades 12*a*, 12*b*, 12*c* may be partially covered by the masking foil 26, on the side of the front edge 20. More precisely, the blade the closest to the front edge 20 may be the first blade 12*a*. In this configuration, the main blade may also be the first blade 12*a*. The second blade 12*b* may be the adjacent blade to the first blade 12*a*. Then the third blade 12*c* may be adjacent to the second blade 12*b*. The third blade 12*c* may also be the middle blade. The two other blades 12*d*, 12*e*, i.e. the two blades closest to the rear edge 22, may be uncovered by the masking foil 26. These two other uncovered blades 12*d*, 12*e*, on the side of the rear edge 22, may increase the shaving efficiency.

Figure 19:
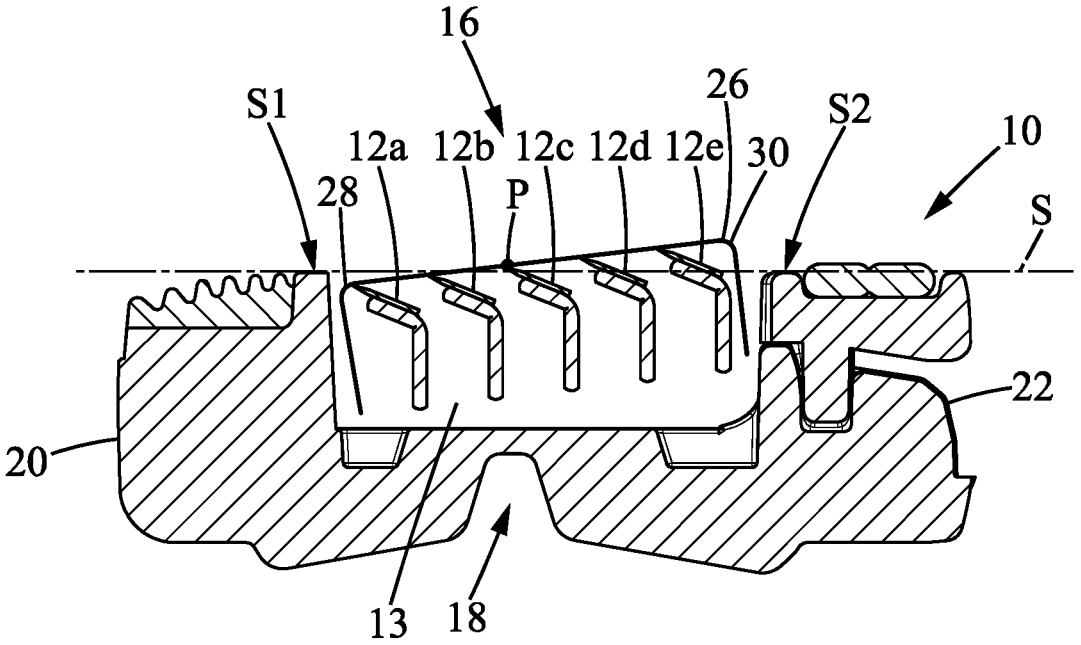

Indeed, the difference between a surface partially covered and a surface uncovered, i.e. without a masking foil 26, may cause two different exposures of the cutting edges 15. The exposure of the cutting edges 15 is the distance of the cutting edges 15 from the shaving plane S, as shown in FIG. 19. A shaving plane S may be defined as a plane comprising a surface S1 and a surface S2. The surface S1 may be located at the top surface 16 of the cartridge. In addition, the surface S1 may be located close to the front portion 28 of the masking foil 26. The surface S2 may be located at the top surface 16 of the cartridge. In addition, the surface S2 may be located close to the back portion 30 of the masking foil 26. This partial blade coverage may provide therefore two different shaving geometries. Thus, the shaving process and experience may be different than the ones with conventional wet shaving cartridges.

Figure 5B:
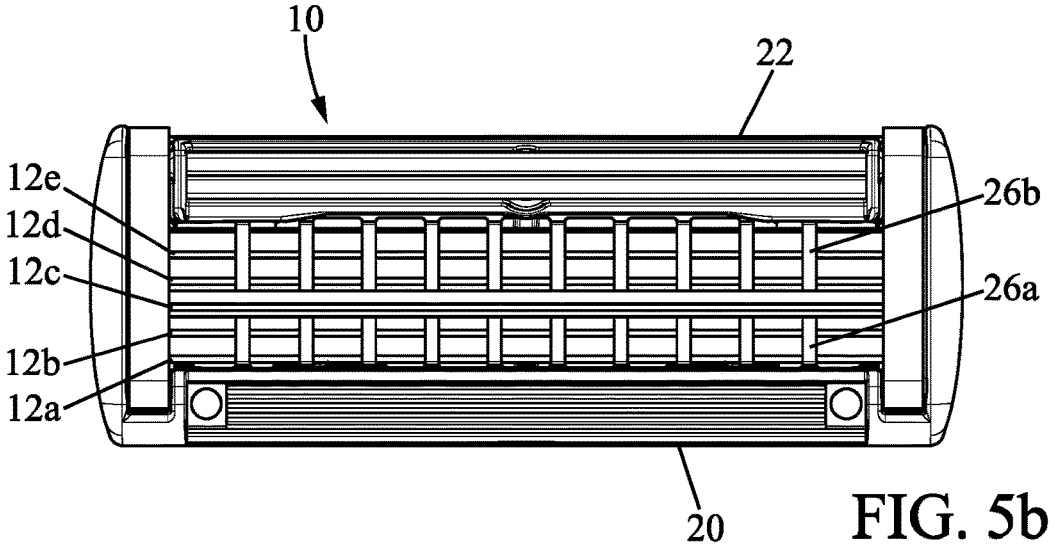
FIGS. 5*b* and 5*c* are top views of two other examples of the shaving cartridge according to the disclosure.

In another example, as depicted in FIG. 5*b*, the shaving cartridge 10 may include multiple masking foils 26. The multiple masking foils 26 can be separate by at least one blade 12. More precisely, as illustrated in FIG. 5*b*, a first masking foil 26*a* may cover partially the cutting edges 15 of the first blade 12*a* and the second blade 12*b*. A second masking foil 26*b* may cover partially the cutting edges 15 of the two blades 12*d*, 12*e* closest to the rear edge 22. The third blade 12*c* may be uncovered. The third blade 12*c* may also be located between the first masking foil 26*a* and the second masking foil 26*b*. The main blade of the first masking foil 26*a* may be the first blade 12*a*. The main blade of the second masking foil may be the forth blade 12*d*.

Figure 5C:
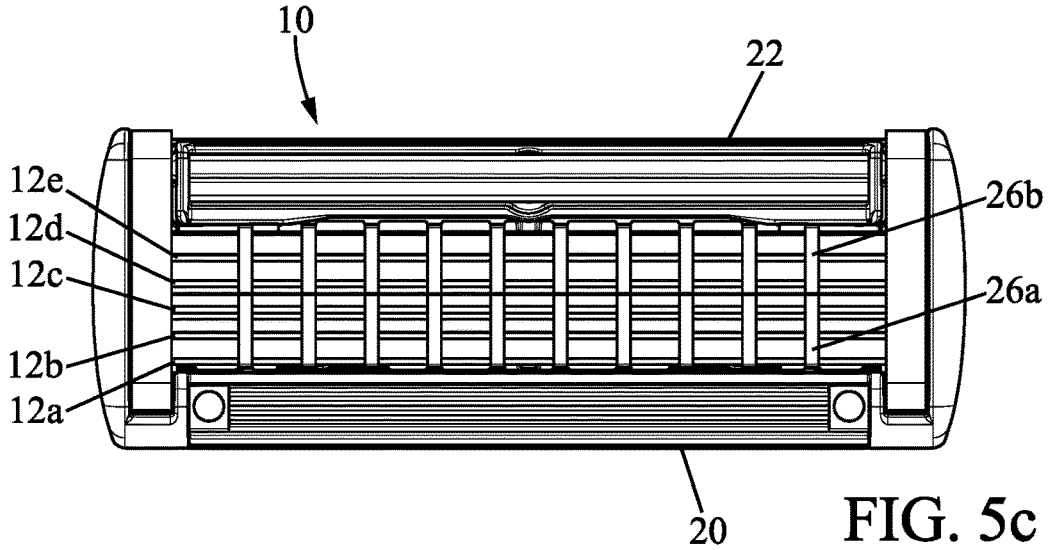

In FIG. 5*c*, the first masking foil 26*a* may cover partially the cutting edges 15 of the first, second and third blades 12*a*, 12*b* and 12*c*. The second masking foil may cover partially the two blades 12*d*, 12*e* closest to the rear edge 22. In another example, the third blade 12*c* could also be partially covered by the second masking foil 26*b* instead of the first masking foil 26*a*.

Therefore, any other combination with regard to the number of masking foil(s) used, the number of cutting edge(s) covered and the location of the masking foil(s) on the covered cutting edge(s) may be possible. In particular, one and/or the other of the following features may be incorporated in the shaving cartridge of the disclosure, alone or in mutual combination:

- The shaving cartridge 10 can may include multiple masking foils 26, depending on the design of the shaving cartridge 10. For instance, the shaving cartridge can include three masking foils 26. The shaving cartridge 10 can also include one masking foil per blade, and/or
- Each cutting edge 15 can be partially covered by a masking foil 26, and/or
- The main blade can be anyone of the blades 12, and/or,
- All the cutting edges 15 can be partially covered by one sole masking foil 26.

The masking foil 26 may include a front portion 28 and a back portion 30 and at least one ribbon 32 extending between the front portion 28 and the back portion 30.

When the masking foil 26 covers each cutting edge 15, the front portion 28 may be located on the side of the front edge 20 and the back portion 30 may be located on the side of the rear edge 22.

As illustrated in FIG. 4, the masking foil 26 of the disclosure can further include at least one securing portion 34. Actually, the masking foil 26 can include two securing portions 34. Each of the two securing portions 34 may be placed close to the corresponding side edge 24.

Figure 7:
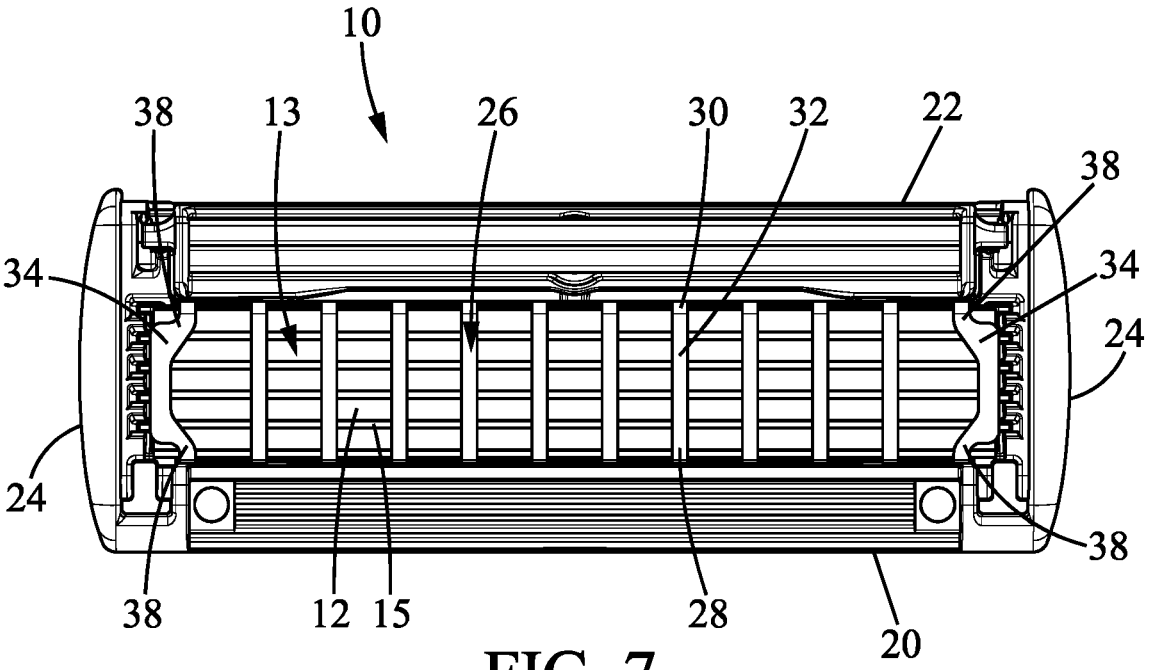
FIG. 7 is a top view illustrating another example of the securing portion of the cartridge of FIG. 2, the blade retainer being removed.
Figure 8:
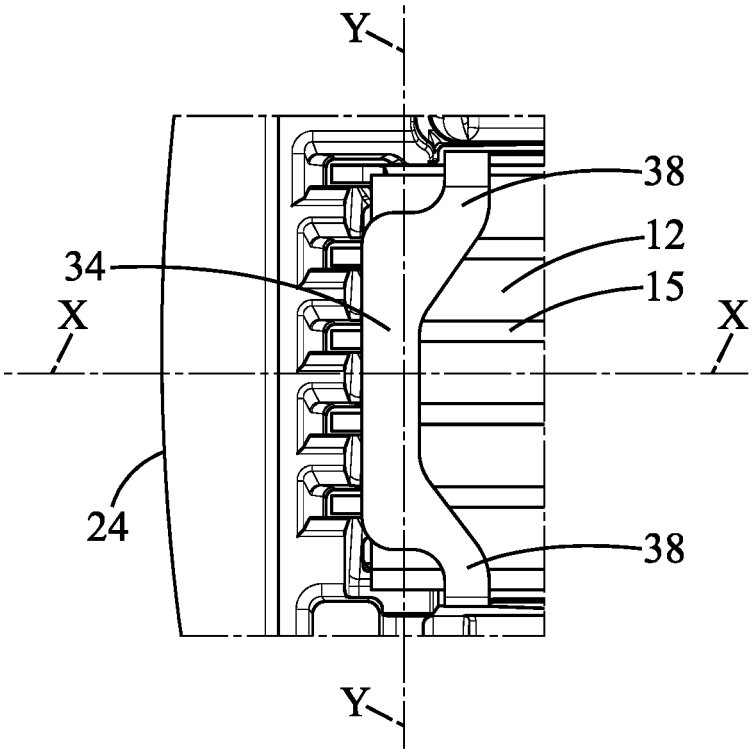
FIG. 8 is a detailed partial top view illustrating another example of the securing portion of the cartridge of FIG. 2, the blade retainer being removed.

The shaving cartridge 10 can further include a blade retainer 36 as visible on FIGS. 2, 3, 5 and 6 for instance. The blade retainer 36 may cover the blades 12 in order to retain them in the housing 13. The blade retainer 36 may be placed at one end of the blades 12, close to a side edge 24. The blade retainer 36 may extend further between the front edge 20 and the rear edge 22 of the cartridge 10. The blade retainer 36 may include a first leg 36*a*, a second leg 36*b* and a body 36*c*. The body 36*c*, first leg 36*a* and second leg 36*b* form a one-piece part. Each leg 36*a*, 36*b* may extend to an end 37. The first leg 36*a* of the blade retainer may surround the side edge 24 of the housing 13, on the side of the rear edge 24. In other words, a portion of the blade retainer 36 may be wrapped around a portion of the housing 13. The second leg 36*b* of the blade retainer 36 may be received in a through hole 39 provided in the housing 13. The through hole 39 may extend transversally through the housing 13 between the top surface 16 and the bottom surface 18. The cartridge 10 can further include two blade retainers 36. As shown in FIGS. 2 and 5 the two blade retainers 36 can be additional members, or as depicted in FIGS. 4, 7 and 8, the two securing portions 34 mounted on the housing 13 can act as blade retainers. The two securing portions 34 in the example of FIGS. 4, 7 and 8 may be attached in the housing 13, thanks to elasticity of the materials of the masking foil 26 and the cartridge 13. More precisely, the two securing portions 34 may be attached in the walls of the housing 13. For example, the masking foil 26 may be press fitted in the housing. The masking foil 26 can also be snap fitted, welded or inserted in the housing 13 of the cartridge 10. The masking foil 26 can also be molded with the material of the cartridge 10.

As shown in FIG. 4, each securing portion 34 may be placed between the cutting edges 15 of the blades 12 and a blade retainer 36 (not shown in FIG. 4), securing thus the position along X axis of the masking foil 26 onto the cartridge 10. As shown in FIG. 2, each blade retainer 36 may cover a corresponding securing portion 34 that may be placed between the blade retainer 36 and the cutting edges 15 of the blades 12. Actually, each securing portion 34 may be sandwiched between the blade retainer 36 and the blades 12. The securing portion 34 may have for example a rectangular shape, like a strip. Its shape may generally be identical to the body 36*c* of the blade retainer 36, which covers the securing portion 34. Therefore, the body 36*c* and the securing portion 34 may have approximatively the same length and width in a top view. The securing portion 34 may cover the blades 12 along a transversal axis Y-Y from the front edge 20 to the rear edge 22 of the cartridge 13. The transversal axis Y-Y can be perpendicular to the axis X-X that is parallel to the blade edge(s).

Each securing portion 34 may have also at least two joining members 38. Each joining member 38 may join respectively the front portion 28 of the masking foil 26 and the back portion 30 of the masking foil 26. The joining member 38 may allow a connection between the securing portion 34 and the remaining members of the masking foil 26.

Coming back to FIG. 3, the masking foil 26 may include at least one ribbon 32. In FIG. 4, the masking foil 26 may include ten ribbons 32, but the disclosure may not be limited to said number of ribbons. The cutting edge 15 of each blade 12 may be covered on an area corresponding to a ribbon 32 placed above this area. If no ribbon 32 is placed above the cutting edge 15, the cutting edge may not be covered on this area. Therefore, if the masking foil 26 includes only one ribbon 32, the cutting edge 15 may include only one covered area and two uncovered areas. If the masking foil 26 includes ten ribbons 32, the cutting edge 15 may include ten covered areas and eleven uncovered areas. Thus, the cutting edge 15 may include as much covered areas as the number of ribbons 32 on the masking foil 26. When the covered areas are not on an extreme location of the cutting edge 15, then the number of uncovered area may be of one more than the number of covered areas.

Each ribbon 32 may extend transversally between the front portion 28 and the back portion 30 of the masking foil 26. An angle $\alpha$, view from the top as shown in FIG. 4, can define the inclination of each ribbon between the axis X-X and the ribbon 32. This angle α can be between 45° and 90° and can vary from one ribbon to another one on the same masking foil. More particularly, the angle α can be between 15° and 90°. As illustrated in FIG. 4, the angle α may be approximatively 90°.

Each ribbon 32 may be connected to a front anchorage area 29*a* via a front bent portion 29 and to a back anchorage area 31*a* via a back bent portion 31 as visible for instance in FIG. 3. These two bent portions 29, 31 may provide rigidity to the ribbons 32 when shaving. Each anchorage area 29*a*, 31*a* may be directed toward the bottom surface 18 of the housing, approximatively along a transversal axis Z-Z from the top surface 16 to the bottom surface 18 of the cartridge 13. Each anchorage area 29*a*, 31*a* may be in an extension of the respective bent portion 29, 31. The anchorage areas 29*a*, 31*a* may not be attached. Thus, when the shaving cartridge 10 includes movable blades 12, the geometry of the masking foil 26 may allow the movements of the masking foil 26 along with the movement of the movable blades 12. In other words, the masking foil 26 can be movable in the housing due to the forces applied by the skin and hair during shaving action. Therefore, in comparison with a masking foil which may not follow the movement of the blades 12, the masking foil 26 may increase the adaptability of the blades 12 and the shaving surface of the skin of the user which may be in contact with the masking foil 26. In addition, the blades 12 can move in the cartridge 10 without compromising the closeness during shaving action.

Figure 9A:
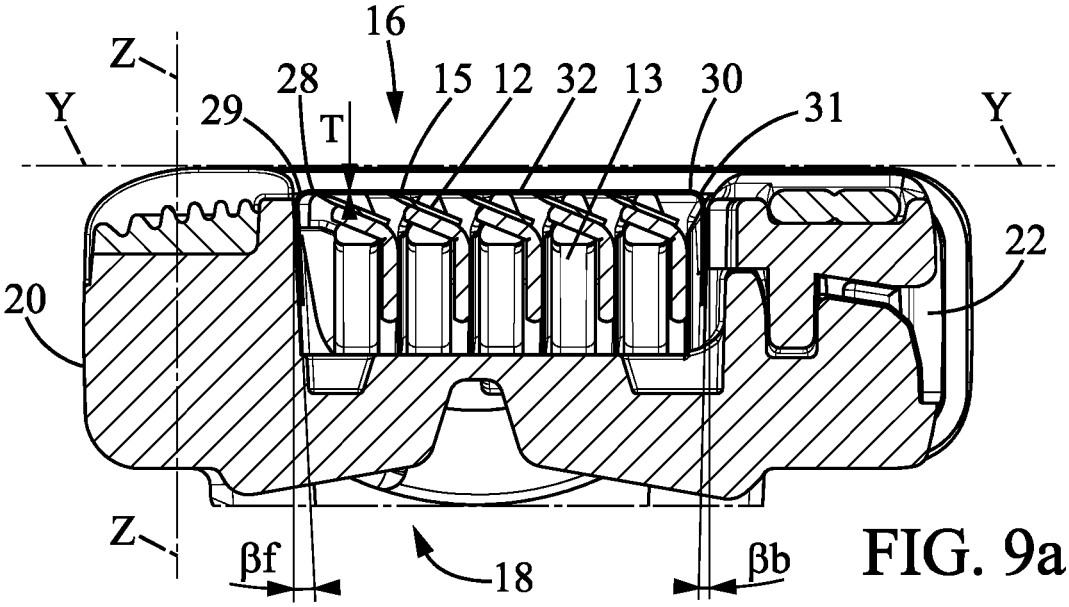
FIGS. 9*a*, 9*b*, 9*c* and 9*d* are cross-sectional views of different shape of the masking foil.

The front anchorage area 29*a* and the back anchorage area 31*a* each may make an angle with the axis Z-Z. The two angles can be equal or not. FIG. 9*a* shows the angle 4 between the back anchorage area 31*a* and the axis Z-Z may be smaller than the angle $\beta_f$ between the front anchorage area 29*a* and the axis Z-Z. This difference may allow a facility assembly between the masking foil 26 and the cartridge 13. For example, the angle $\beta_f$ between the front anchorage area 29*a* and the axis Z-Z and the angle $\beta_b$ between the back anchorage area 31*a* and the axis Z-Z may be between 0° and 25°.

As depicted in FIG. 9*a*, the shape of the ribbon 32, in the covered area, may be flat viewed in a cross-sectional view. Its thickness T may be measured along the axis Z-Z from the side of the top surface 16 to the side of the bottom surface 18. The thickness T can be between 20 μm and 5000 μm. In particular, the thickness T may be between 40 μm and 60 μm. The thickness T may be for example of about 50 μm.

Besides, the coverage percentage of the ribbons 32 can be between 1% and 70%. In particular, the coverage percentage of the ribbons 32 may be between 5% and 20%. For example, when the masking foil 26 includes ten ribbons 32, the coverage percentage of the masking foil 26 by the ribbons 32 may be of about 20%. The ribbons 32 may be parallel to each other, transversally between the front portion and the back portion of the masking foil. The distance D between each ribbon may be defined as the perpendicular segment between the lateral sides of two adjacent ribbons 32. The width W of a ribbon 32 may be the distance between its two lateral sides. The distance D can be between 3 mm and 3.25 mm. The width W can be between 0.63 mm and 0.72 mm. Considering a cutting edge 15 with a length of about 34 mm and a masking foil 26 comprising ten ribbons 32, the distance D between each adjacent ribbon 32 would be of about 3.15 mm. In this case, the width W is 0.68 mm. The number of apertures, or i.e. uncovered area may be eleven.

FIGS. 9*a*, 9*b*, 9*c* and 9*d* illustrate different shapes of the masking foil 32, in view from a side edge.

In FIG. 9*a*, the shape of the ribbon 32 may be flat. The ribbon 32 is substantially parallel all along the axis Y-Y. The ribbon 32 may rest on each cutting edge 15.

Figure 9B:
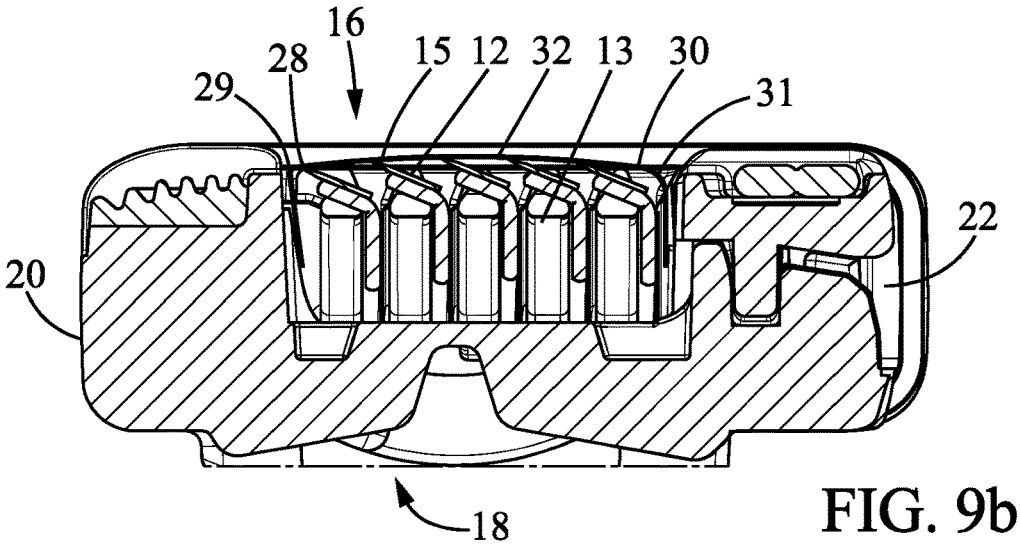

In FIG. 9*b*, the shape of the ribbon 32 may be curved. The cutting edge 15 may follow the shape of the masking foil 26, thus the cutting edge 15 may have an exposure between −200 μm to +200 μm. For example, the curve can be a convex surface, according to axis Z-Z, from the bottom surface 18 to the top surface 16. The convex shape provides a better accessibility in hard to reach anatomical regions. Thus, this shape may improve a shaving efficiency and precision.

Figure 9C:
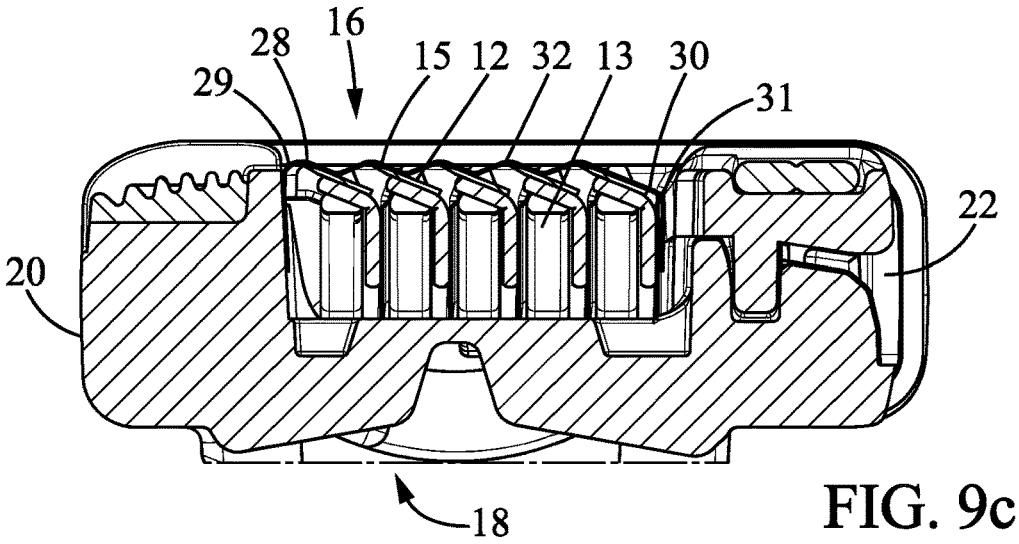

In FIG. 9*c*, the shape surface may be corrugated. Actually, the masking foil 26 may follow the shape of the cutting edge 15 and a part of the blades 12. The corrugations may stabilize and/or regulate the exposure and/or the angle of each blade 12. The cutting edges may have an exposure between −200 μm to +200 μm. The blade angle may be the same, different or progressive. The corrugations may reduce the skin contact surface, thus reducing the shaving cartridge to skin friction.

Figure 9D:
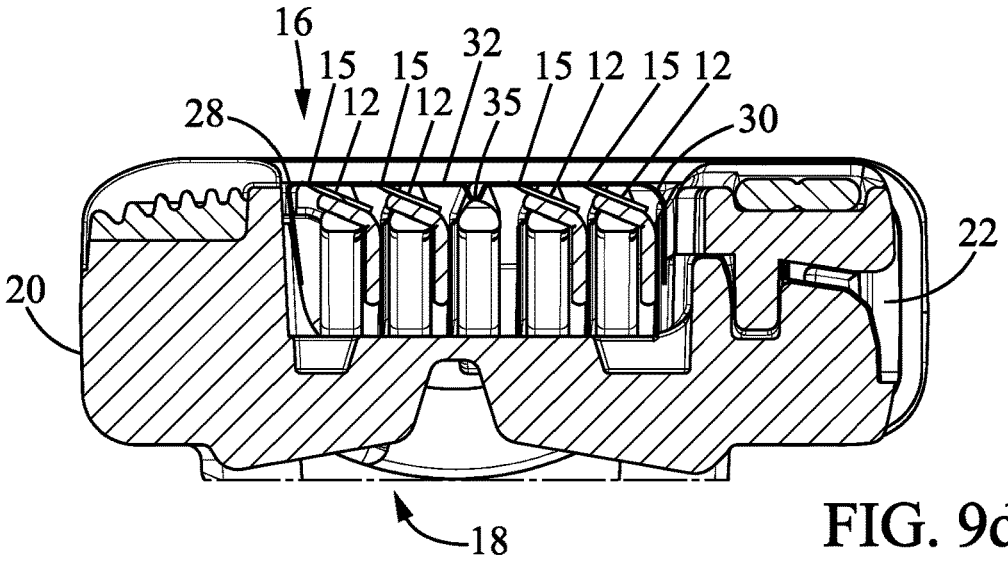

In FIG. 9*d*, the shape of the ribbon 32 may be partly flat, viewed in a cross-sectional view. Indeed, the ribbon 32 may include a groove 35. The groove 35 may be disposed approximatively in the middle of the ribbon along its longitudinal axis. Any other combination, with regard to the number of groove 35 and its position on the masking foil 26, may be possible. In particular, one and/or the other of the following features may be incorporated in the shaving cartridge of the disclosure, alone or in mutual combination:

- The groove 35 may be disposed closer to the front portion 28 than the back portion 30, or closer to the front portion 30 than the back portion 28 and/or,
- The masking foil can include two grooves 35 or more and/or,
- The masking foil comprising the groove(s) 35 can be used with the examples described above or below. For example, the shaving cartridge 10 includes multiple masking foils 26, each masking foil 26 comprising one groove 35.

Such shape surfaces may allow to manage the exposure of the blades with respect to a shaving plane. The cutting edges may have an exposure between −200 μm to +200 μm.

Figure 10A:
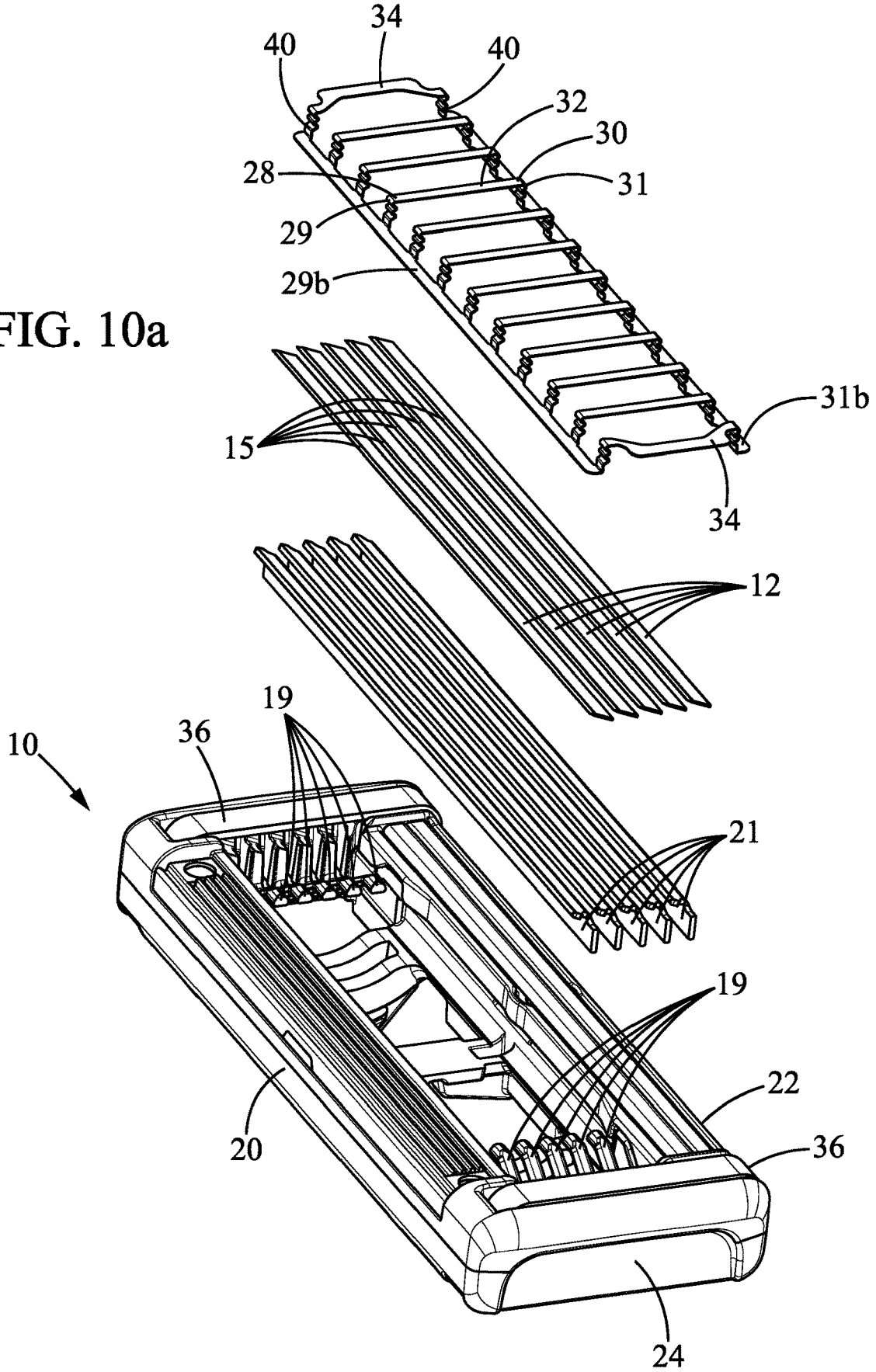
FIGS. 10*a* and 10*b* show respectively an exploded perspective view and a cross-sectional view of another example of the cartridge according to the disclosure.
Figure 10B:
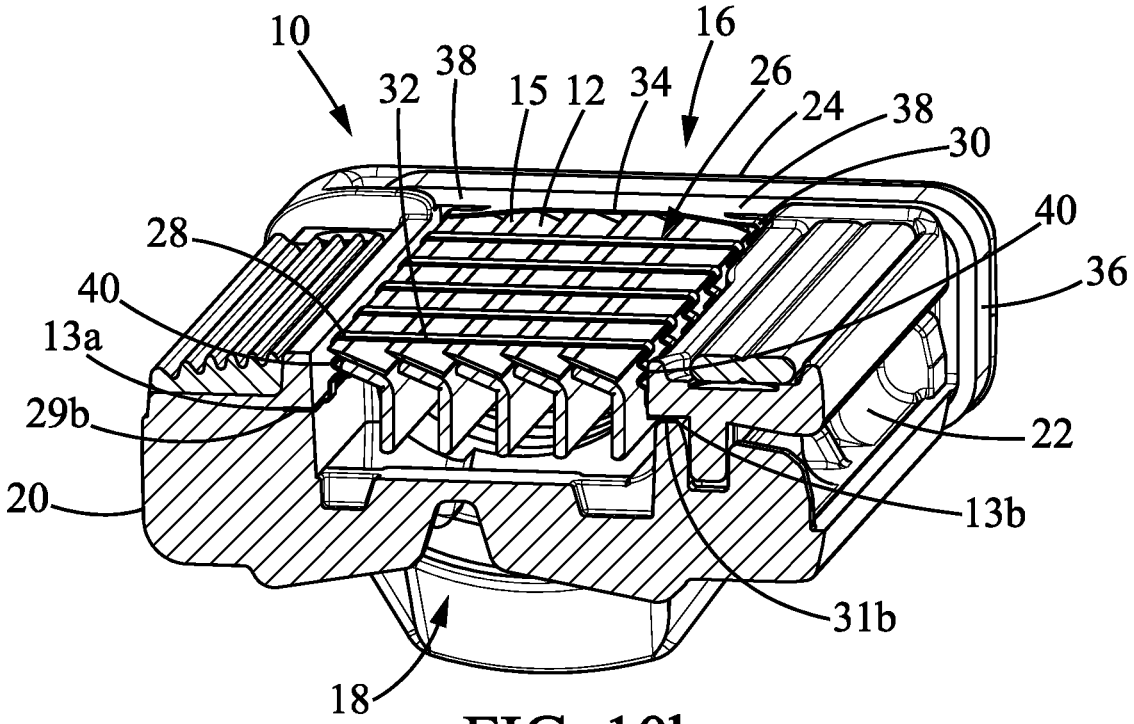
Figure 11:
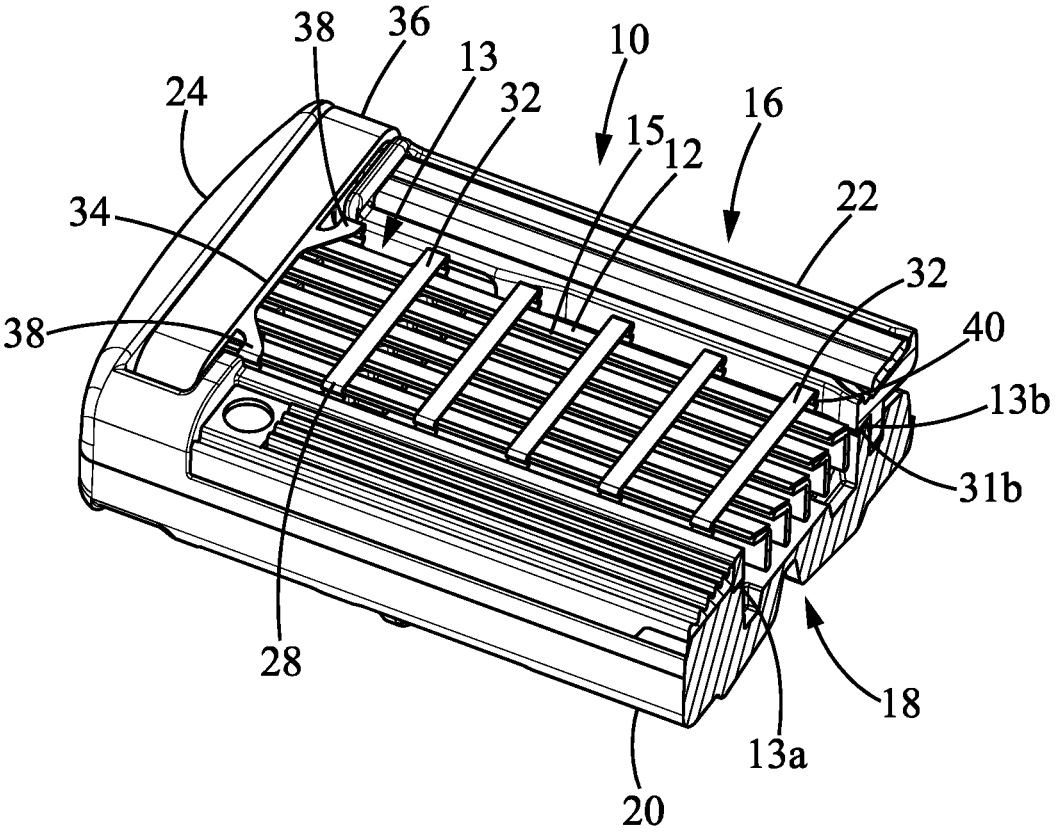
FIG. 11 is a cross-sectional in a perspective view of the cartridge of FIG. 10.

FIGS. 10*a*, 10*b* and 11 illustrate another example of the present disclosure where elastic means may be further provided. This example may be analogous to the example of FIG. 3, except an elastic means 40 may be provided with the masking foil 26 between the bent portion and the anchorage area of the masking foil 26 as visible in FIGS. 10*a* and 10*b*. Actually, an elastic means 40 can be provided on each side of a ribbon 32, between a bent portion and an anchorage area. Thus, an elastic means 40 can be placed between the front bent portion 29 and the anchorage area 29*b*. An elastic means 40 can also be provided on the masking foil 26 between the back bent portion 31 and the anchorage area 31*b*. In this example, the anchorage areas 29*b*, 31*b* may be attached in the housing 13 and can act as a blade retainer. Two slots 13*a*, 13*b* may be provided in the housing 13. Each slot may be parallel to the top surface 16 or the bottom surface 18. Each slot may open outwardly the cartridge 13 and may receive one of the two anchorage areas 29*b*, 31*b*.

The elastic means can be, for example, a spring. In that case, the material of the masking foil can be at least locally sufficiently elastic to allow an elastic deformation of the elastic means. It can also be made of multiple folds. Thus, the geometry of the masking foil 26 may allow the movement of the masking foil 26 along with the movement of the movable blades 12 whereas the anchorage areas may be unmovable. Even if an elastic means 40 may be particularly suitable for a shaving cartridge 10 with movables blades 12, this example can be used with non-movable blades 12.

Figure 10C:
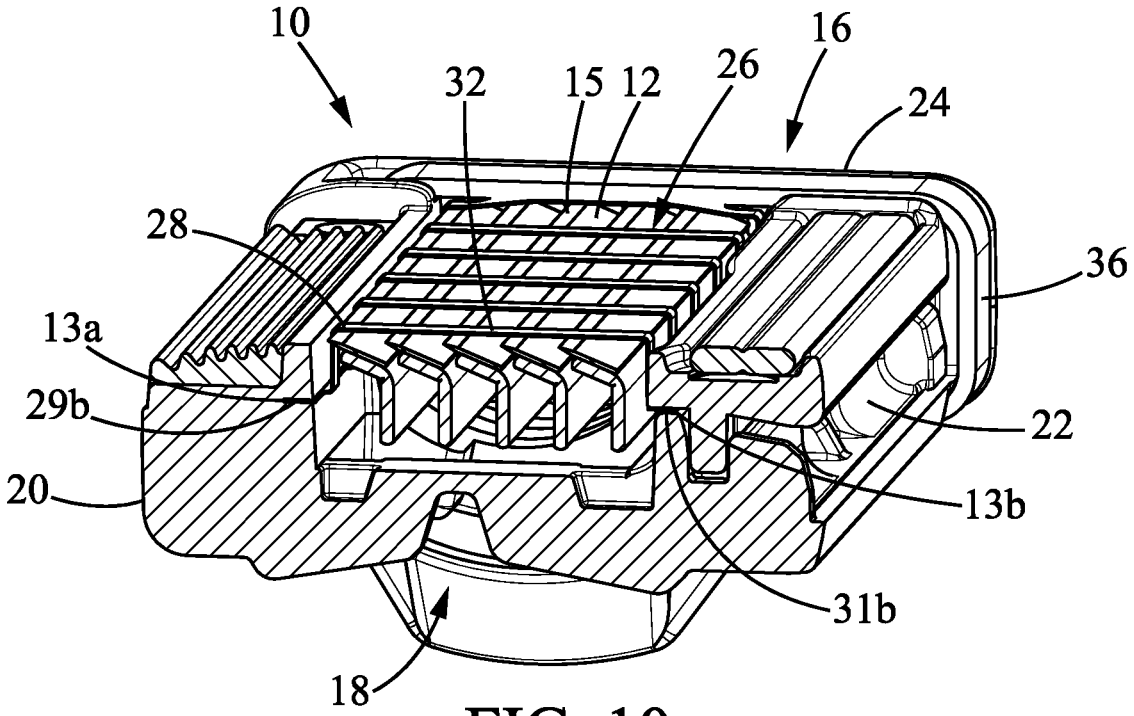
FIG. 10*c* shows a cross-sectional view of another example of the cartridge according to the disclosure.

Regardless the blades 12 may be movable or not, the masking foil 26 can be provided without the elastic means 40. For example, as depicted in FIG. 10*c*, the masking foil 26 may not be provided with the elastic means 40. However, the masking foil can include the anchorage areas 29*b*, 31*b*. The two anchorage areas 29*b*, 31*b* may also be attached in the housing 13 and can act as a blade retainer. Indeed, when the blades 12 are movable, the blades 12 can move toward the bottom surface 18 during shaving. When the blades 12 move toward the top surface 16 to return to their rest position (non-shaving), the movement of the blades may be stopped by stumbling against the masking foil 26. As depicted in FIG. 10*a*, each blade 12 may be borne by a bent support 21. In another aspects, not shown in the figures, the blade(s) may include a cutting edge portion, a base portion and a bent portion intermediate the cutting edge portion and the base portion, which may be integrally formed. In another aspect, not shown in the figures, the blade(s) may not be borne by a bent support 21 and be welded below the masking foil. Therefore, the masking foil 26 can act as a shield for the blades 12. Regardless of the elastic means 40, the masking foil 26 can also be elastically biased along with the movable blades 12. When the shaving cartridge 10 includes also blade retainer 36, the blade retainer 36, together with the masking foil 26, may secure the blades 12 in the cartridge 10. In such configuration, i.e. where the blades 12 may be movable, the shaving cartridge 10 may include elastic fingers 19 (shown in FIGS. 6 and 10*a*). Such elastic fingers 19 are for example described in the publication WO2007147420 (in name of BIC VIOLEX). The movement of the masking foil 26 may be therefore indirectly managed by the elastic fingers 19.

FIGS. 12*a*, 12*b*, 12*c*, 12*d*, 12*e*, 12*f*, 12*g* and 12*h* illustrate different examples of possible pattern of the masking foil 26 where the angle α between the front portion 28 and the ribbon 32 may not be not equal to 90°. FIG. 12*i* illustrates another example of possible pattern of the masking foil 26.

Figure 12A:
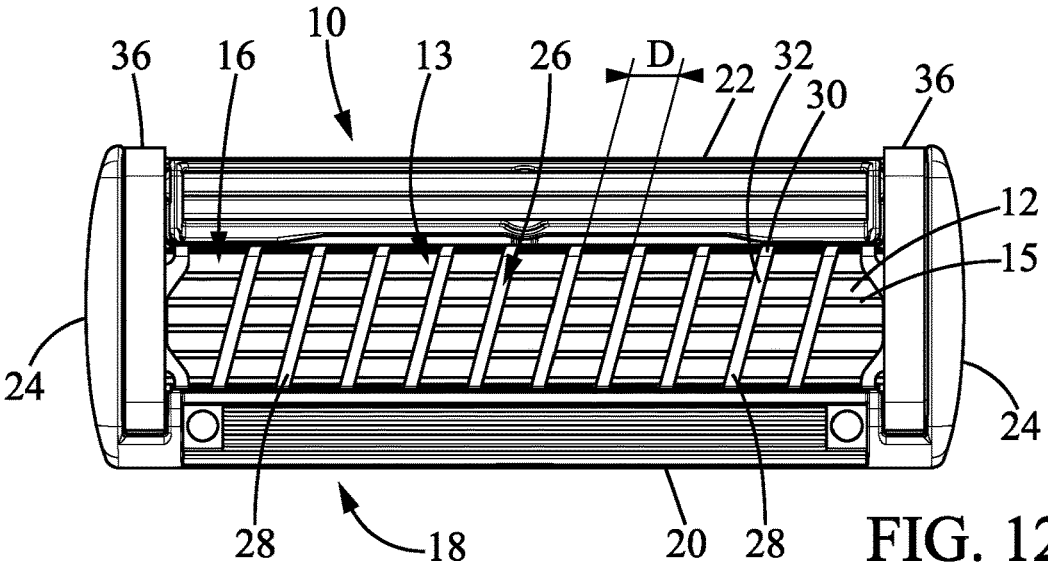
FIGS. 12*a*, 12*b*, 12*c*, 12*d*, 12*e*, 12*f*, 12*g*, 12*h*, 12*i* are illustrations of different masking foil patterns.

In FIG. 12*a*, all the ribbons 32 are oriented in the same direction. The angle α may be substantially equal to 20°. The ribbons 32 may extend transversally between the front edge 20 and the rear edge 22, without contacting the securing portion 32.

Figure 12B:
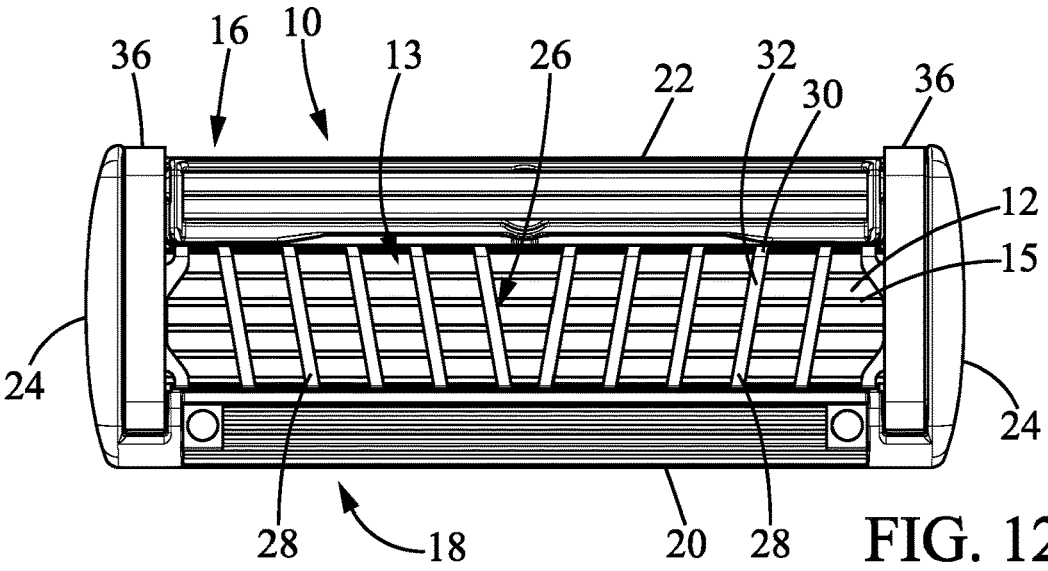
Figure 12C:
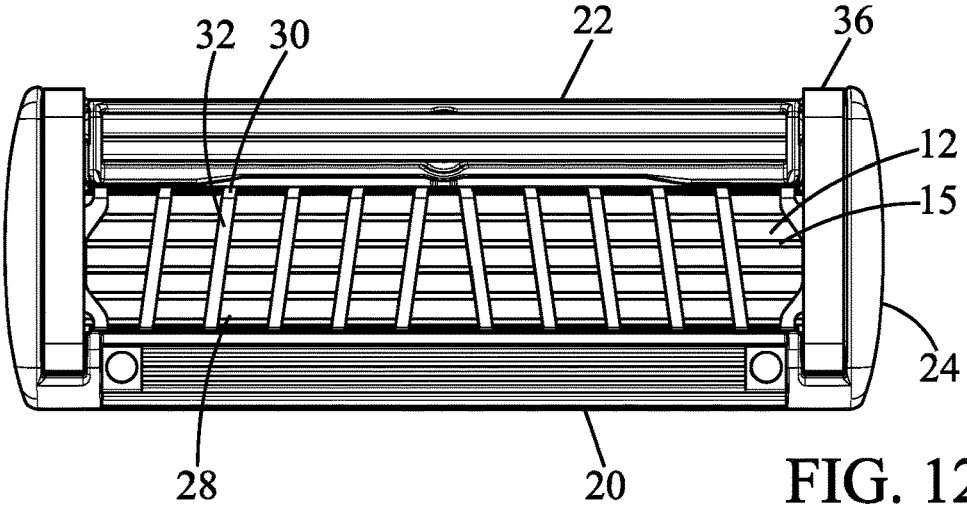

In FIGS. 12*b* and 12*c*, all the ribbons 32 are oblique but not oriented in the same direction. The masking foil 26 may be symmetrically separated in its middle, for instance, in the direction from one side edge to the other side edge 24. The first half of the ribbons 32, i.e. the ribbons 32 between the first side edge 24 and the middle of the masking foil 26 may be inclined in a direction whereas the second half of the ribbons 32, i.e. the ribbons 32 between the middle of the masking foil and the second side edge 24, may be inclined with the same angle α but in an opposite direction. The ribbons 32 may extend transversally between the front edge 20 and the rear edge 22, without contacting the securing portion 32.

Figure 12D:
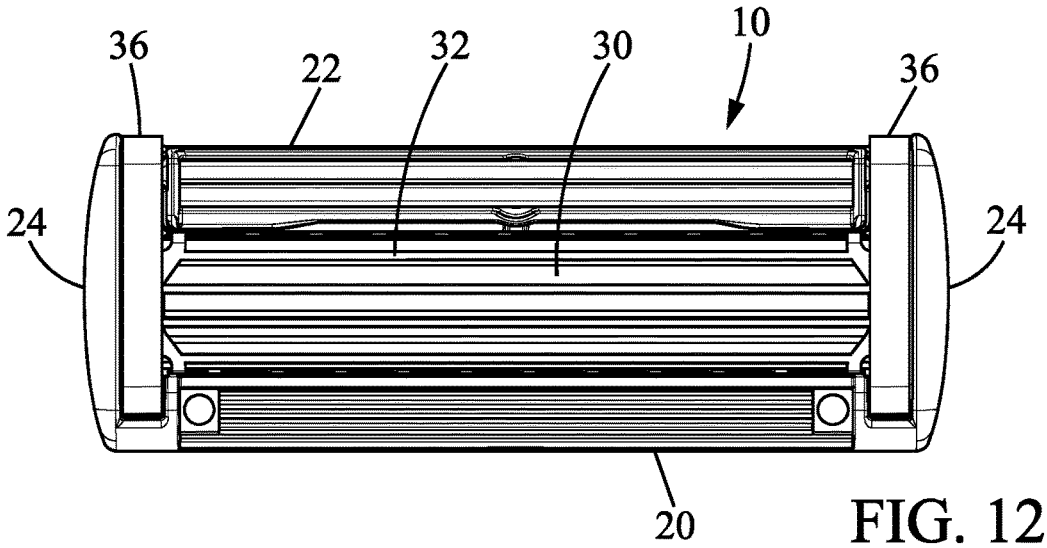

In FIG. 12*d*, the ribbons 32 extend transversally between the two side edges 24.

Figure 12E:
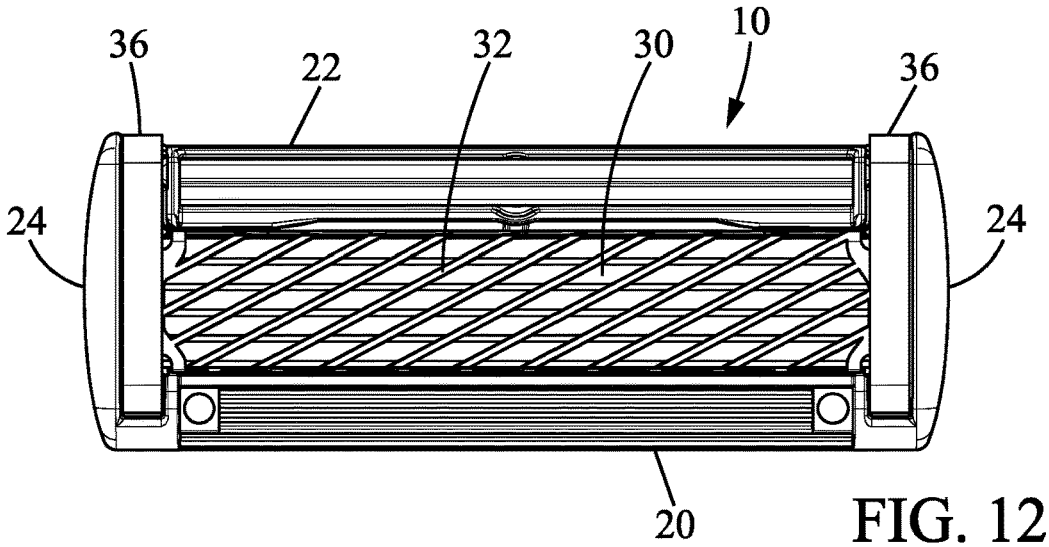

In FIG. 12*e*, all the ribbons 32 may be oriented in the same direction. The ribbons 32 may extend transversally between the front edge 20 and the rear edge 22. The ribbons 32 closest to the side edge 24 may contact the securing portion 32.

Figure 12F:
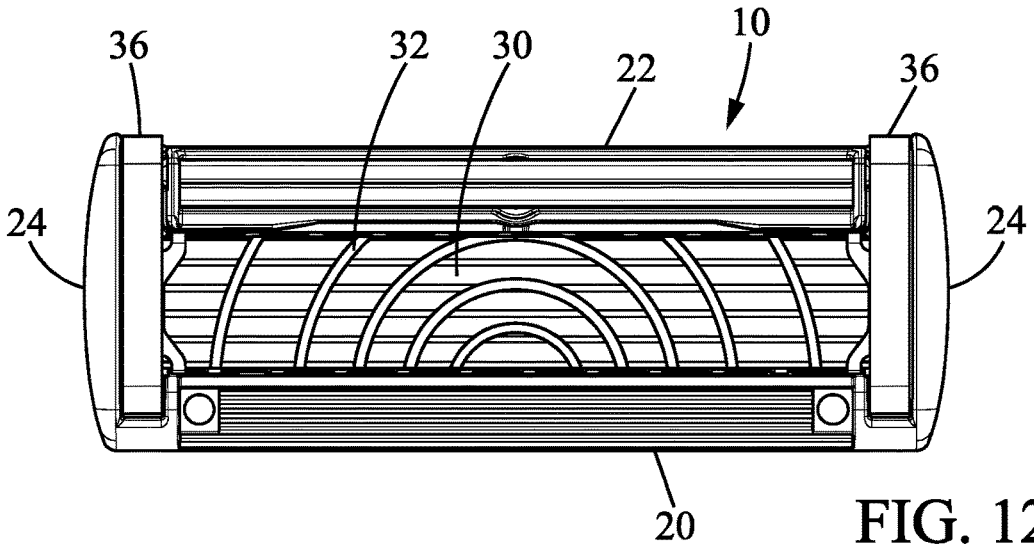

In FIG. 12*f*, the ribbons 32 may be oriented according to a circumferential direction. Thus, the shortest ribbon may extend from and to the front edge 20. The longest ribbon may extend between the frond edge 20 and the rear edge 22.

Actually, any combination of number of ribbons and of their inclination angle can be provided on the masking foil:

- each of the ribbons of a masking foil can be inclined in the same direction, with the same angle α,
- each of the ribbons of a masking foil can be inclined in the same direction, with different angles α from one ribbon to another one,
- some of the ribbons of a masking foil can be inclined in opposite directions, with the same angle α,
- some of the ribbons of a masking foil can be inclined in opposite directions, with different angles α from one ribbon to another one, etc.

Thus, the pattern of the masking foil can manage the direction of the hairs in relation to the cutting edge. The oblique ribbons 32 may provide hair cutting effect which may improve shaving comfort during shaving.

Figure 12G:
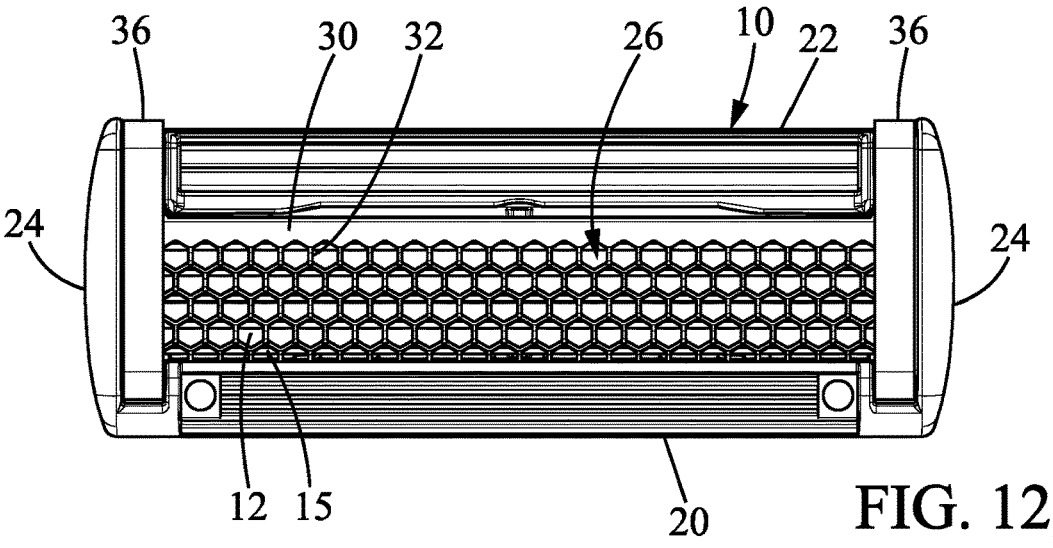
Figure 12H:
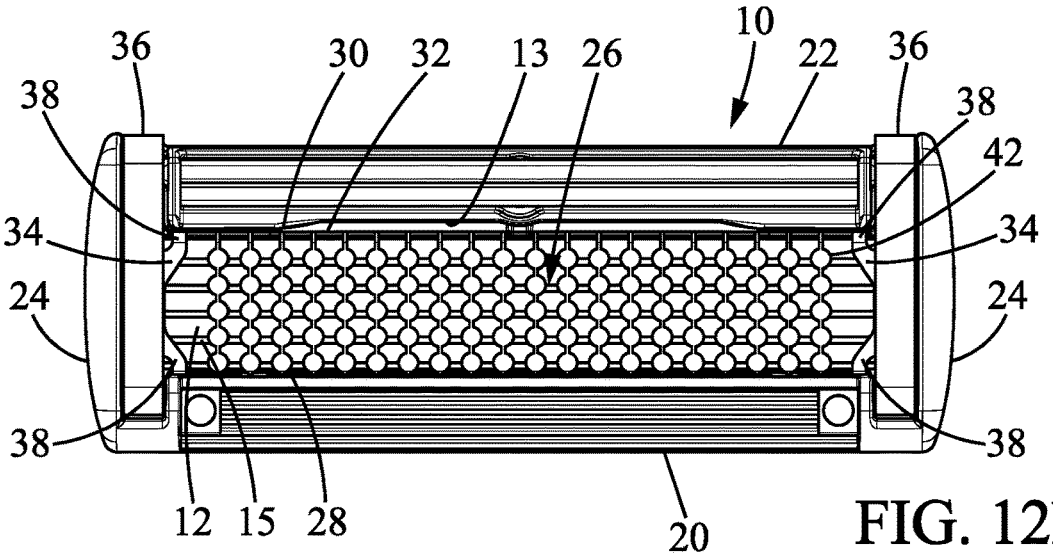
Figure 12I:
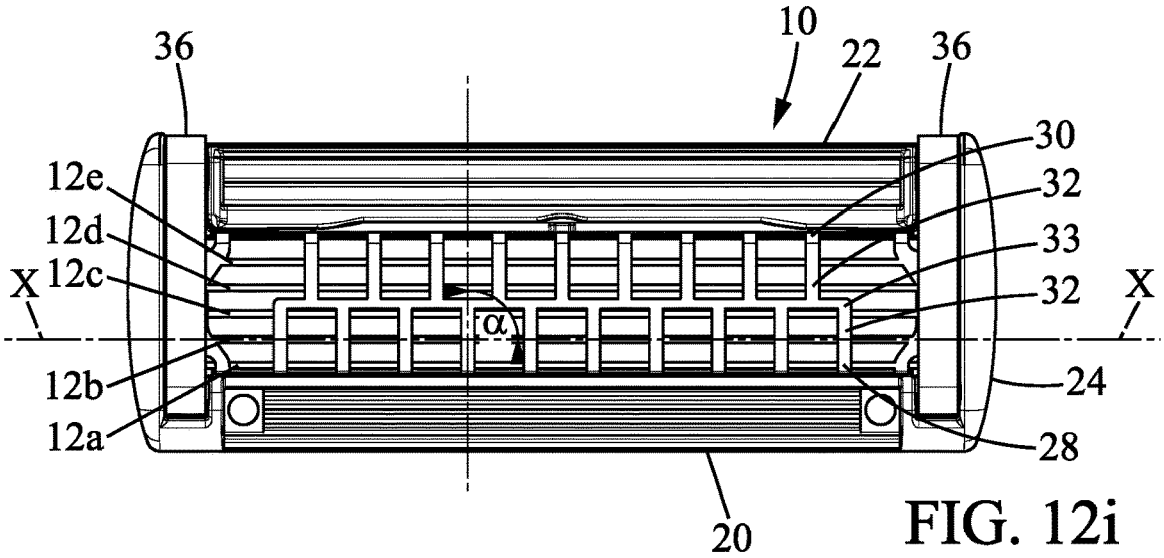

FIGS. 12*g* and 12*h* shows a masking foil 26 with particular ribbon patterns. Actually, as depicted in FIG. 12*g*, the ribbons 32 form a skin contacting surface with a hexagonal configuration, like a honeycomb. In FIG. 12*h*, ribbons 32 do not have a straight form. The ribbons 32 may include several circular shapes 42. The pattern of shapes 42 can also be rhomboidal.

In another example, as depicted in FIG. 12*i*, the shaving cartridge 10 may include a masking foil 26 comprising an intermediate portion 33. The intermediate portion may extend in parallel to the front edge 20 and the rear edge 22. Each ribbon 32 may extend transversally from the front portion 28 or the back portion 30 to the intermediate portion 33. In this configuration, the angle α may be approximatively 90°. The ribbons 32 which may extend from the front portion 28 to the intermediate portion 33 may be staggered with respect to the ribbons which may extend from the back portion 30 to the intermediate portion 33.

In addition, any combination of the configurations or patterns described above may be possible.

The masking foil 26 can further include stainless steel. It can also include a material chosen from the group consisting of plastic material, composite, aluminum, aluminum alloys and/or noble metals chosen among gold or platinum. Metals such as aluminum and its alloys may improve corrosion and oxidation resistance of the blades 12 through anodic protection process. Thus, since the blade retainer 36, which includes aluminum, may no longer contacting blades 12, the masking foil may play the role of anodic protection.

In order to enhance functionality of the masking foil, it can include a wound healing and/or an anti-bacterial agent. The masking foil can also include a lubricating coating, such as hydrophobic or hydrophilic, such as a polyfluorocarbon, for example, polytetrafluoroethylene (PTFE) or hydrogel coating. This coating may provide a reduction of the friction between the shaving cartridge and the skin.

The masking foil can also have color properties. For instance, different colors can be provided on the masking foil in order to distinguish the male or female utilization. For instance, the masking foil can be blue when intended to a man shaving razor, and red or pink when intended to a woman shaving razor.

The masking foil can also be provided with a material which may have properties allowing a changing of the color after a particular number of uses. For instance, the masking foil can be green when never utilized and red when worn.

In another example not shown in figures, in order to improve adaptability of the masking foil 26 on skin contours, the masking foil 26 may be placed above the top surface 16 of the shaving cartridge 10. The bent portions 29, 30 may be wrapped around the front edge 20 and the rear edge 22, extending toward the bottom surface 18 of the shaving cartridge. The masking foil 10 may act as a blade retainer 36.

The description of the disclosure above may be made in relation with a shaving cartridge 10 comprising one or several blades 12 provided in a housing 13, in which the blade(s) 12 can be movably or fixedly retained in the housing 13. But the disclosure may not be limited to the previous features. The following examples can also apply to the masking foil of the disclosure.

Figure 13:
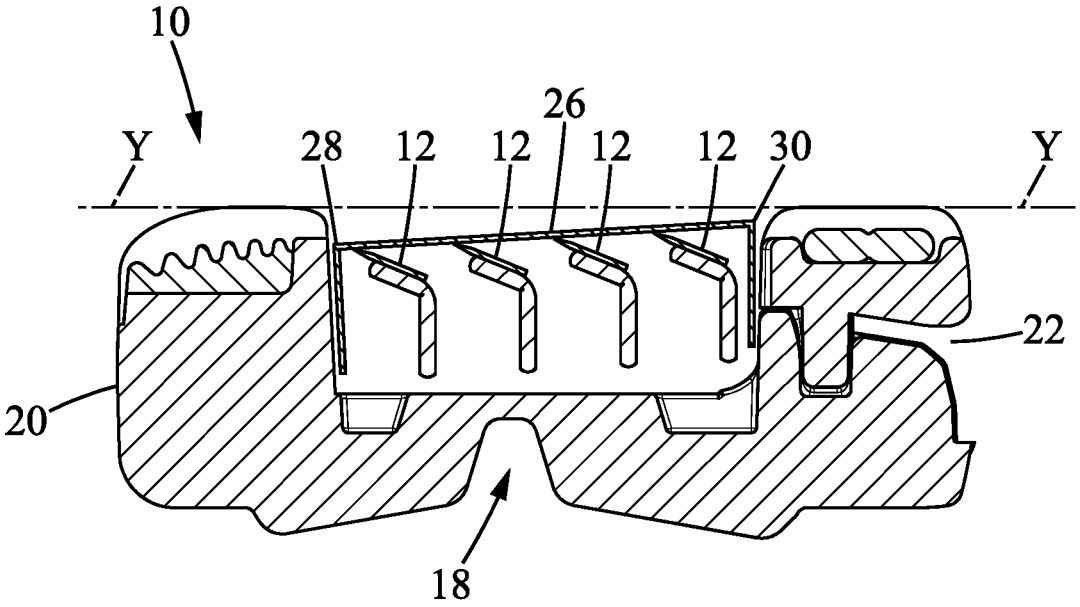

FIG. 13 shows an example in which the masking foil may not be parallel to the transversal axis Y-Y. Indeed, in this example, the blade's exposure may be progressive (i.e. a progressive increase or decrease of the exposure of the blades). The ribbon 32 of the masking foil 26 may be oriented in such a manner that it may follow the exposure of the blades. The cutting edge 15 may have an exposure between −200 μm to +200 μm. In other words, the masking foil 26 may be closer to the transversal axis Y-Y at its back portion 30 than at its front portion 28. In addition, the shape of the ribbon 32, in the covered area, may be flat viewed in the cross-sectional view of this figure. In this example, the friction between the shaving cartridge and the skin may be reduced during shaving.

Figure 14:
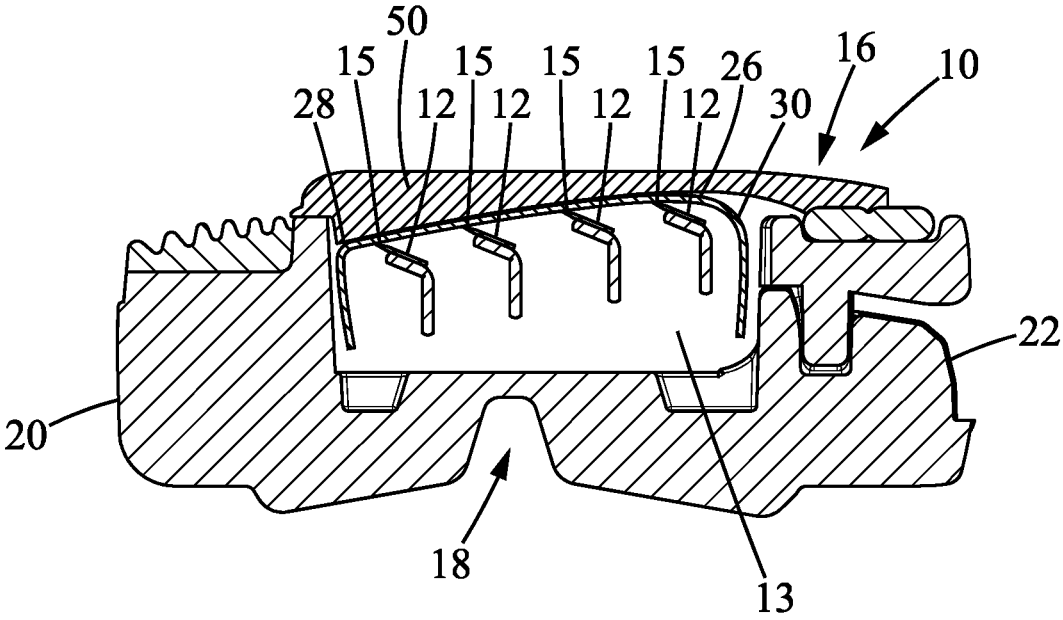

FIG. 14 shows another example of the masking foil 26. In such an example, the masking foil 26 may be identical the one of FIG. 13 and may include, in addition, a plastic cover 50. More precisely, the plastic cover 50 may extend above the ribbons 32. In this example, the cutting edges 15 may have a progressive exposure, between −200 μm to +200 μm, improving hair removal. Besides, the plastic cover 50 may extend from the front portion 28 to the back portion 30 of the masking foil 26, at the top surface 16 of the housing 13. In addition, the plastic cover 50 may exceed from the ribbons 32. For example, the plastic cover 50 may exceed toward the front edge 20 of the housing 13 and the rear edge 22 of the housing 13. The plastic cover 50 may also exceed toward the side edges 24 of the housing 13. The plastic cover 50 may rest thus on parts of the top surface 16 of the housing 13.

Figure 15A:
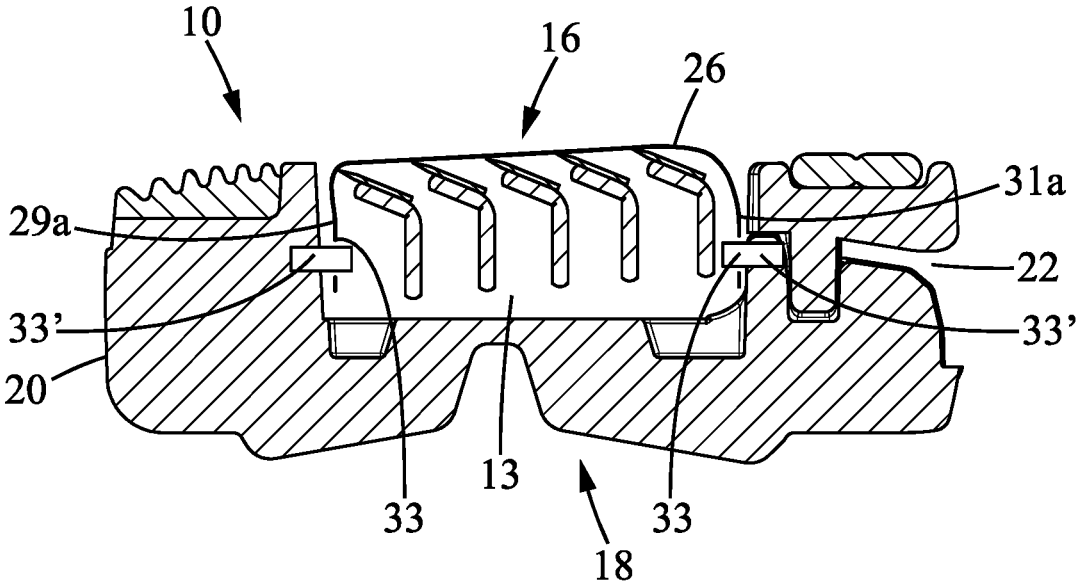
Figure 15B:
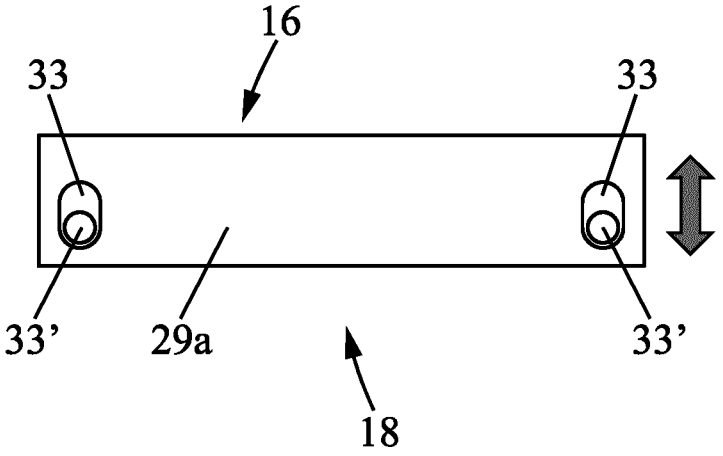

In another example, depicted in FIGS. 15*a* and 15*b*, the front anchorage area 29*a* and the back anchorage area 31*a* may include holes 33. The holes 33 may cooperate with corresponding pins 33'. The pins 33' may be provided in the housing 13 outwardly the housing 13. The pins 33' can for example be molded with the housing 13. As depicted in FIG. 15*b*, the holes 33 may be oblong holes whereas pins 33' are cylindrical. Therefore, in case of movable blades, the geometry of the masking foil 26 may allow thus the movement of the masking foil 26 along with the movement of the movable blades 12. In the example illustrated in FIGS. 15*a* and 15*b*, both the front anchorage area 29*a* and the back anchorage area 31*a* may each include two holes 33. Each hole may be located laterally of the anchorage area in a front view, as depicted in FIG. 15*b*. Thus, the housing 13 may include four pins 33'. However, according to another example, the anchorage area can include one hole 33, or more than two holes. In another example, the holes 33 can be circular. In that case, the masking foil 26 may be fixedly mounted to the housing 13.

Figure 16:
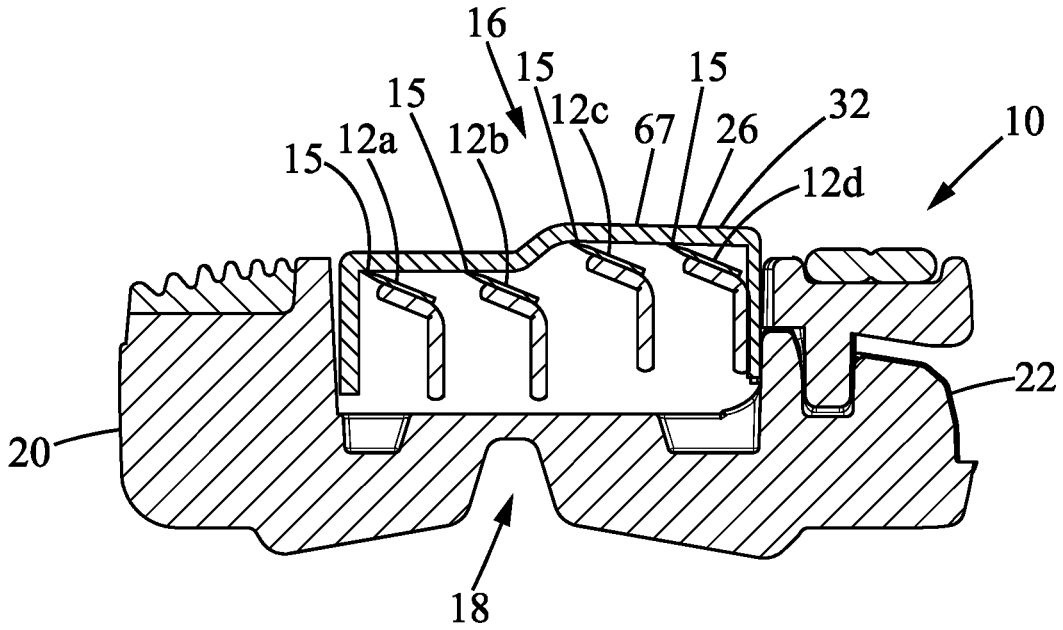
Figure 17:
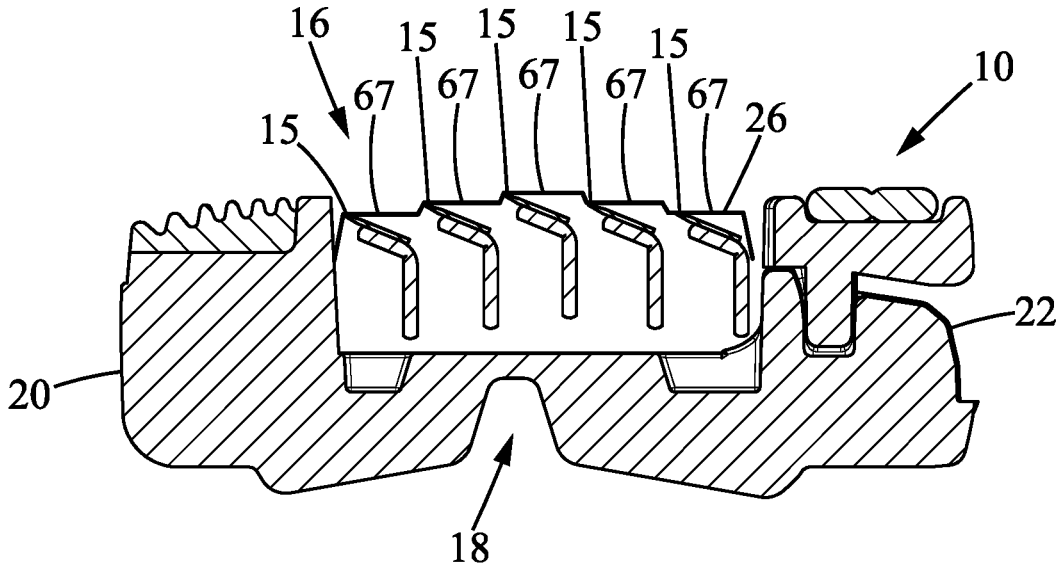
Figure 18:
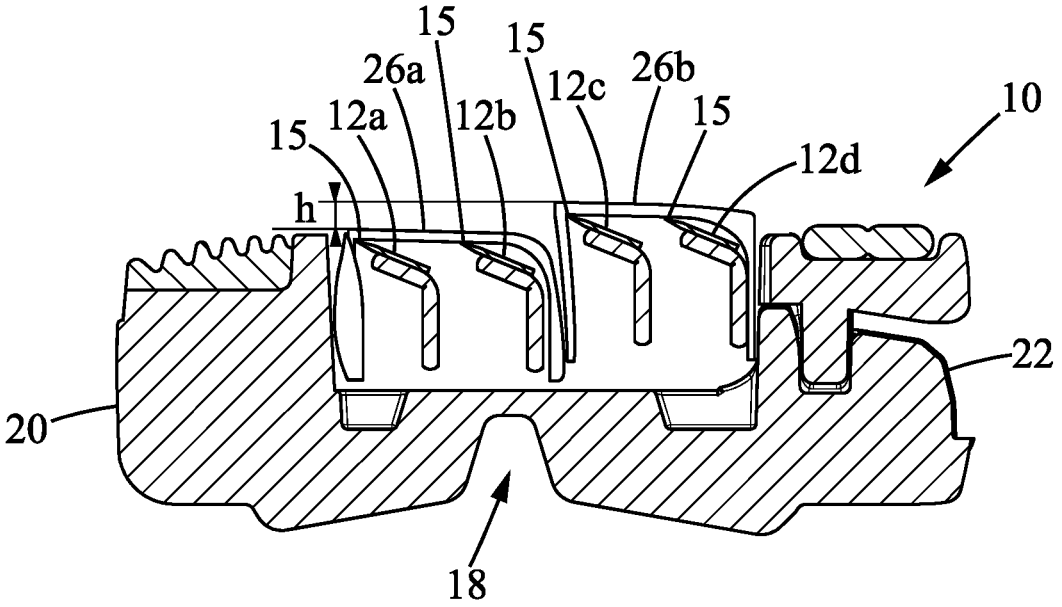

In another example, illustrated in FIG. 16, the blades may be designed to form two different exposures. The blades, when in a cross-sectional side view, may form a kind of step 67. For example, the first blade 12*a* and the second blade 12*b* may be at a first exposure. The third blade 12*c* and the fourth blade 12*d* may be at a second exposure. The first exposure may be different from the second exposure. The shape of the ribbon 32 may be provided to follow the different exposures. A cartridge configuration with two different exposures and a masking foil can substitute a configuration with a progressive exposure of the blades. In other word, such a masking foil, may improve glideness, may reduce nicks and cut irritations during shaving. In another example, illustrated in FIG. 17, the ribbon 32 may include as many steps 67 as blades 12. Each step 67 may correspond to a different exposure of the blade, providing a better shaving on difficult areas of skin. In another example, illustrated in FIG. 18, the shaving cartridge 10 may include multiple masking foils. The multiple masking foils may be at the same level or at different level. For example, the shaving cartridge 10 may include two masking foils 26*a* and 26*b*. The distance h between the level of the masking foil 26*a* and the level of the masking foil 26*b* may be vary from 0 to 400 μm. Each masking foil 26*a* and 26*b* may be provided to correspond to a batch of blades with the same exposure. For example, the first and second blades 12*a* and 12*b*, defining the first exposure may be covered with a first masking foil 26*a*. Likewise, the third and fourth blades 12*c* and 12*d*, forming the second exposure may be covered with a second masking foil 26*b*. In this example, the feature of two masking foils for different exposures may have the advantage to offer better adaptability to skin contours than the feature with one masking foil. In addition, in all of the above-mentioned examples the cutting edges 15 may have an exposure between −200 μm to +200 μm.

In another example, illustrated in FIG. 19, the masking foil 26 may include a joint. The joint permits a pivot movement of the masking foil 26, inside the housing 13. To this aim, the joint may be placed on the securing portion 34. The pivot movement may be provided according to a pivot axis P. The pivot axis P may be close to the cutting edge 15 of the third blade 12*c*. The pivot axis P can also coincide to the third blade 12*c*. In this example, the third blade 12*c* may be the middle blade. The third blade 12*c* may be immovable and the rest of the blades (i.e. the first, second, fourth and fifth blades 12*a*, 12*b*, 12*d* and 12*e*) may be movable according to the pivot movement of the masking foil 26. When the front portion 28 of the masking foil 26 goes below a shaving plane S, the same may happen gradually to the first and second blades 12*a* and 12*b*, with the first blade 12*a* going even deeper than the second blade 12*b*. The back portion of the masking foil 26 may lift above the shaving plane and so do the fourth blade 12*d* and the fifth blade 12*e*, with the fifth blade 12*d* moving higher than the fourth blade 12*d* (i.e. the fifth blade may have a larger exposure than the fourth blade 12*d*). A shaving plane S may be defined as a plane comprising a surface S1 and a surface S2. The surface S1 may be located at the top surface 16 of the cartridge. In addition, the surface S1 may be located close to the front portion 28 of the masking foil 26. The surface S2 may be located at the top surface 16 of the cartridge. In addition, the surface S2 may be located close to the back portion 30 of the masking foil 26. Such a masking foil 26 may offer a more constrained way of how the blades may move during shaving. This may lead to a good adaptability of the blades on the surface to shave, improving shaving performance.

In another example, the masking foil 26 may be flexible. Through the creation of a masking foil 26 that may be thick enough to be flexible to adapt to face contours, the masking foil 26 can act as a flexible casing for the blades 12. In addition, by making the center of the masking foil 26 fixed and free to pivot, the blades 12 can follow inwards or outwards the contours of the face. The movement of the masking foil 26 may be initiated by the continuous exertion of force by the elastic fingers 19. The masking foil 26 that may be hinged at its center by the plastic cartridge 10, may have the tendency to be lifted upwards by the elastic fingers 19. Depending on the face contours the shaving plane may self-adjust accordingly.

Figure 20:
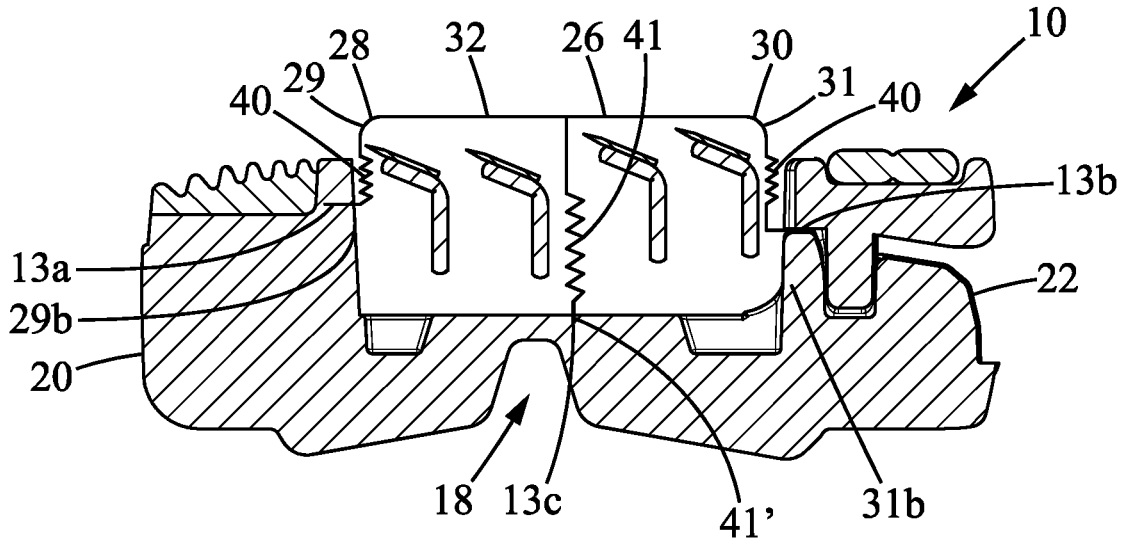

In another example, illustrated in FIG. 20, the masking foil 26 may be similar to the one of FIG. 10*a*, but may have an additional elastic means 41. The additional elastic mean 41 may be provided on the middle of the ribbon 32. More precisely, the elastic means 41 may be located at the middle of the ribbon, between the front portion 28 and the back portion 30 of the masking foil 26. In this example, the additional elastic means 41 may include an additional anchorage area 41'. The additional anchorage area 41' may be fixedly mounted to the housing 13. More precisely, the housing may include an additional slot 13*c*. The additional slot 13*c* may be located in the housing 13, between the two adjacent blades which may be separated with the additional elastic means 41. For example, the additional anchorage area 41' may be snap-fitted in the additional slot 13*c*. In this example, during shaving the pressure from the skin may be applied to the additional elastic mean 41, thus the masking foil 26 may follows better the skin contours.

Figure 21:
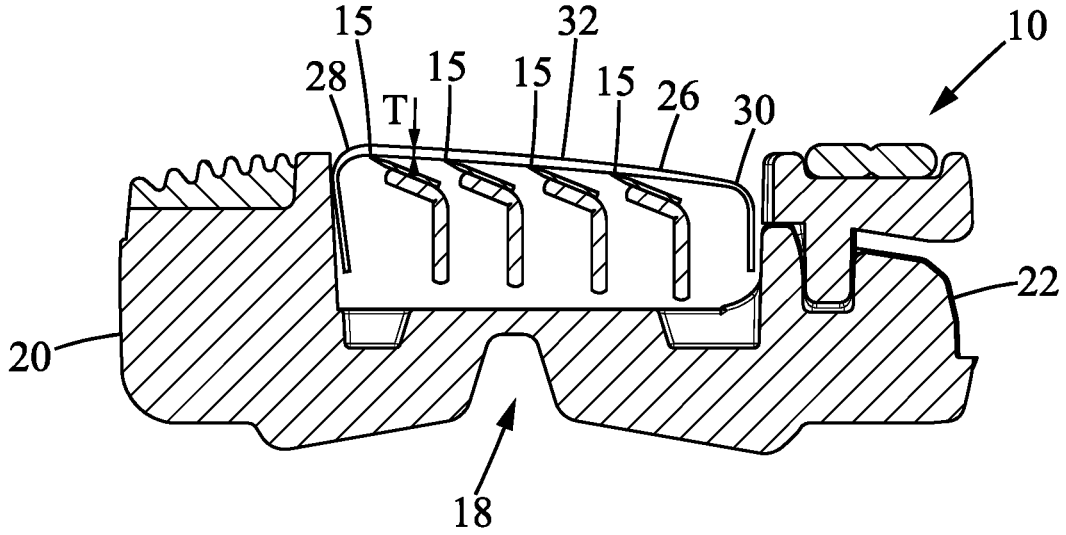

In another example, illustrated in FIG. 21, the thickness T of the ribbon 32 may be not constant all along the ribbon 32. More precisely, in this example, the thickness T may decrease from the front portion 28 to the back portion 30. In another example, the thickness T may increase from the front portion 28 to the back portion 30. For example, the thickness T may decrease from 100 μm to 50 μm. This shape may vary the pressure from the skin. The cutting edges 15 may follow the shape of the masking foil 26. Each cutting edge 15 may have different exposure, between −200 μm to +200 μm. In this example, the masking foil 26 may have a better interaction with the skin, minimize the friction between the shaving cartridge and the skin, and provide a more efficient and closer hair removal.

Figure 22:
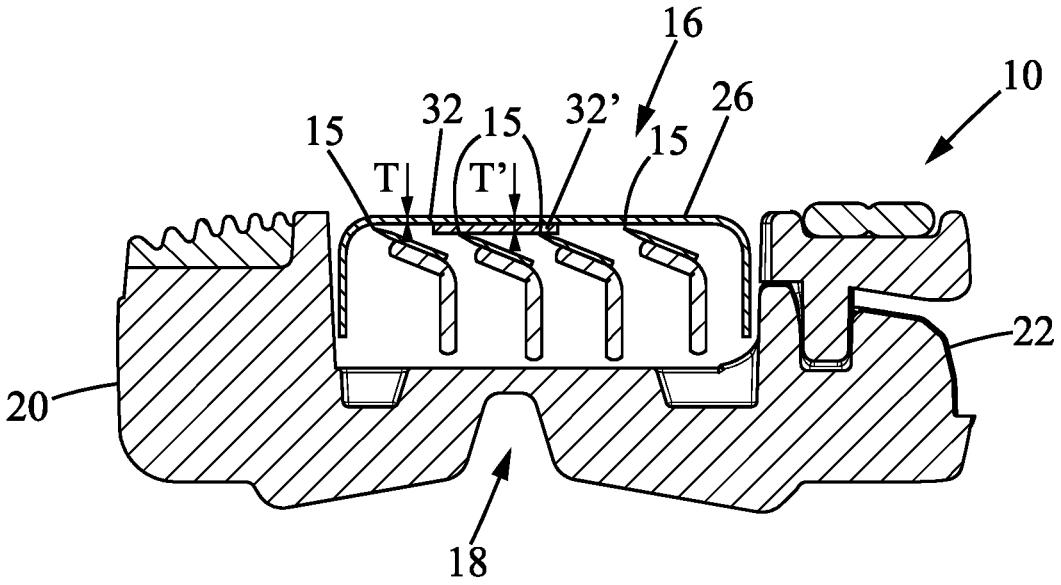

In another example, illustrated in FIG. 22, one or more ribbons 32 can have a portion 32' with a thickness T' larger than the thickness T of the rest of the ribbon 32. For example, as shown in FIG. 22, a portion 32' of the ribbon 32 may cover the cutting edge 15 of a second blade 12*b* and of a third blade 12*c*. When in a cross-sectional view, the ribbon 32 may have a flat shape towards the top surface 16. Actually, the difference of thickness may be only visible in the surface of the ribbon 32 that may face the bottom surface 18 of the housing 13. In addition, the cutting edges 15 may have different exposure between −200 μm to +200 μm. Such a masking foil may improve hair removal or may also provide the possibility to trim hair.

In another example, the thickness of the masking foil can be different from one ribbon to another ribbon. As a result, for example, the trimmed hair will may have different lengths, due to these different thicknesses.

In another example, the masking foil 26 may be welded to the blade retainer 36. For example, the two securing portions 34 may be welded with the corresponding blade retainer 36, enchancing the attachment of the masking foil to the shaving cartridge.

Figure 23:
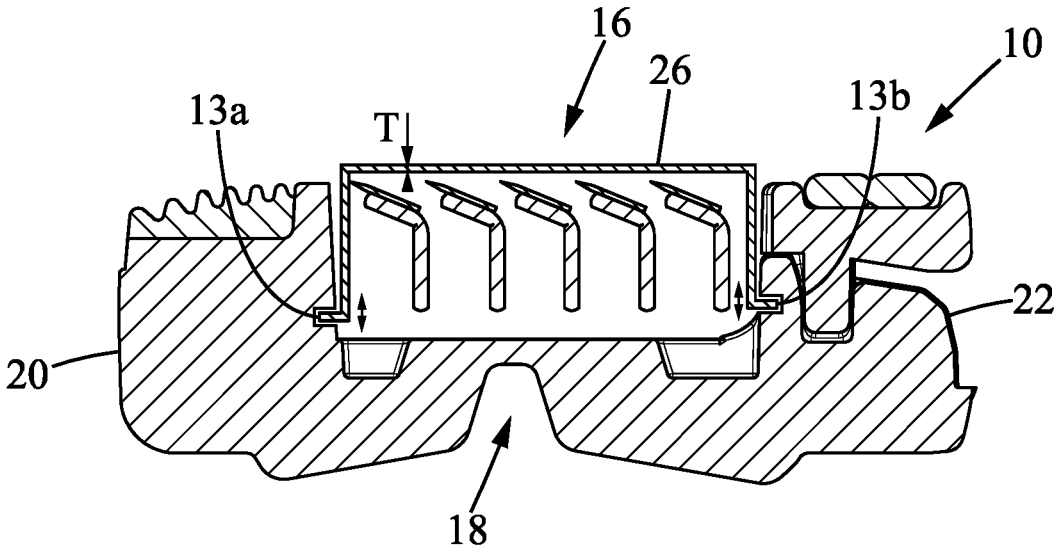

In another example, illustrated in FIG. 23, the slots 13*a* and 13*b* may be provided to allow the masking foil 26 to move toward the bottom surface 18 or the top surface 16. In other words, the slots 13*a* and 13*b* may have a thickness larger than the thickness T of the masking foil 26. For example, the slots 13*a* and 13*b* may have a thickness which may correspond to twice the thickness T of the masking foil 26. In that way, the masking foil 26 can move upwards and downwards during shaving, providing a better shaving on difficult areas of skin and improving hair removal.

Figure 24:
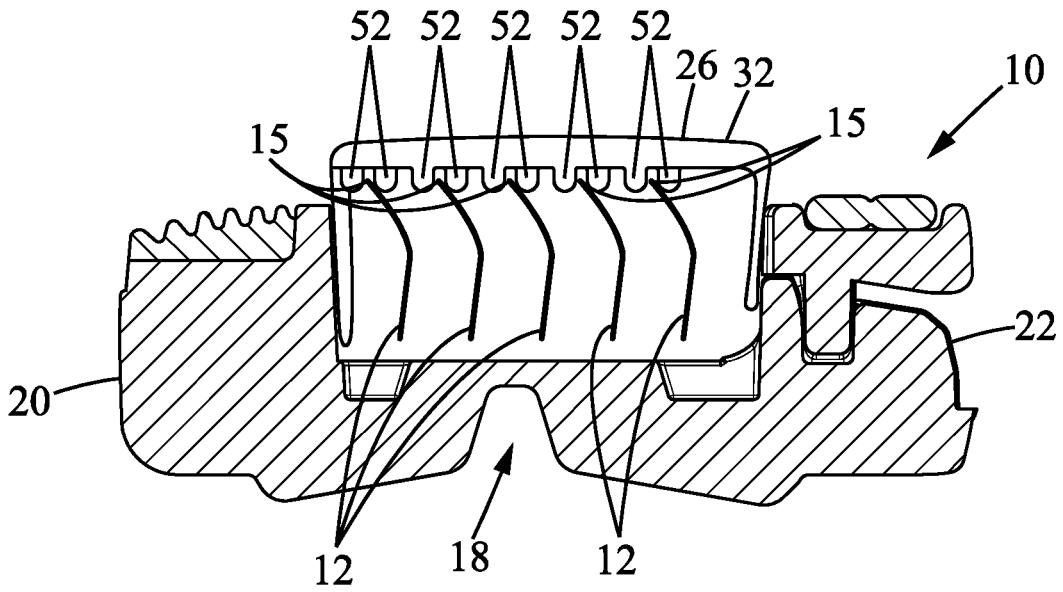

In another example, illustrated in FIG. 24, the ribbons may have protrusions 52 that stabilize the blades. Such protrusions may secure the inter blade span between two adjacent cutting edges 15. The inter blade span may be between 0.5 μm to 1.6 μm. More precisely, the surface of the ribbon 32 which may be in contact with the cutting edge 15 of each blade 12 may include protrusions 52. The ribbon 32 may include two protrusions 52 per cutting edge 15. These two protrusions 52 may block the cutting edge 15 in a desired position. Therefore, a protrusion may aim to bend the blade 12 in a desired configuration, reducing nicks and cuts and irritations during shaving.

Figure 25:
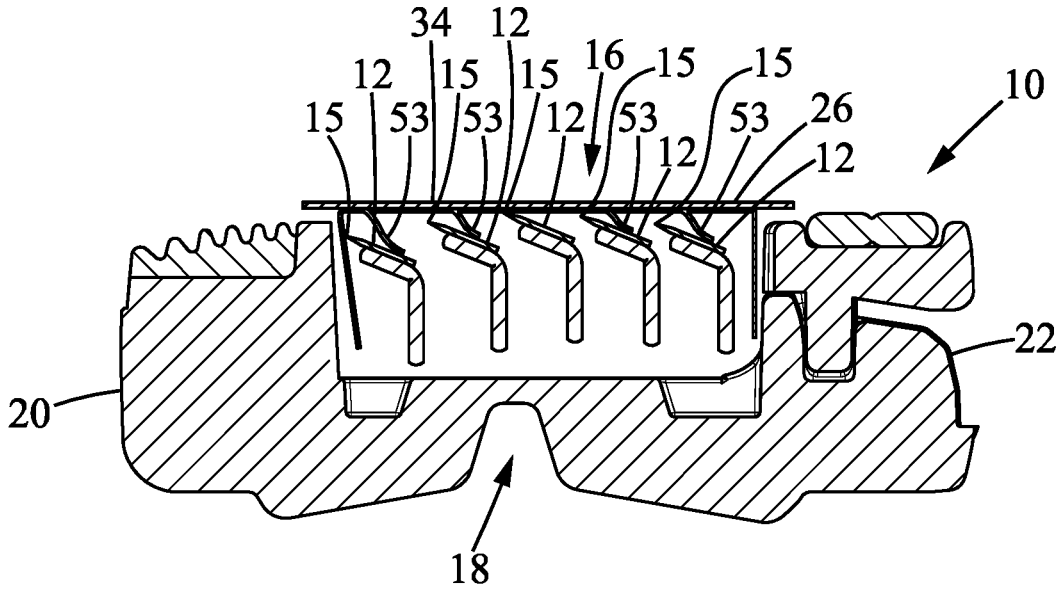

In another example, illustrated in FIG. 25, the securing portion 34 may have fingers 53. The fingers 53 may be oriented toward the bottom surface 18. Each finger 53 may have a specific length. The masking foil 26 and each finger 53 may be made either as single piece or may be separated pieces joined together by using any well known method, such as laser welding. Each finger 53 may press on a corresponding blade 12. When the blades 12 are movable, the specific length of the fingers 53 may provide a progressive exposure of the blades 12. Each cutting edge 15 may have different exposure, between −200 μm to +200 μm. This example, may reduce shaving cartridge to skin friction during shaving, and improve the rinsability of the shaving cartridge.

Figure 26A:
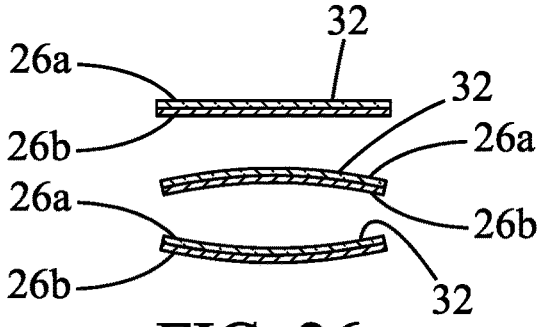
Figure 26B:
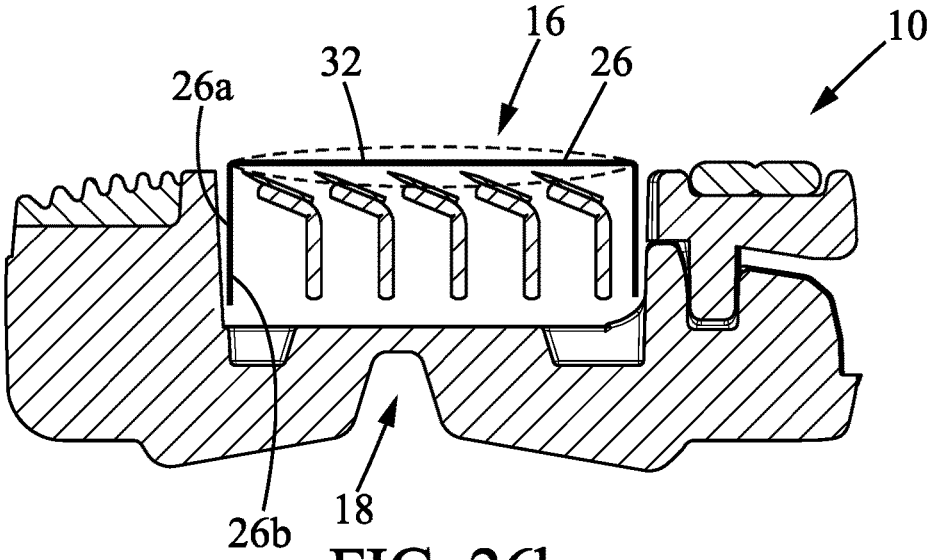
Figure 42:
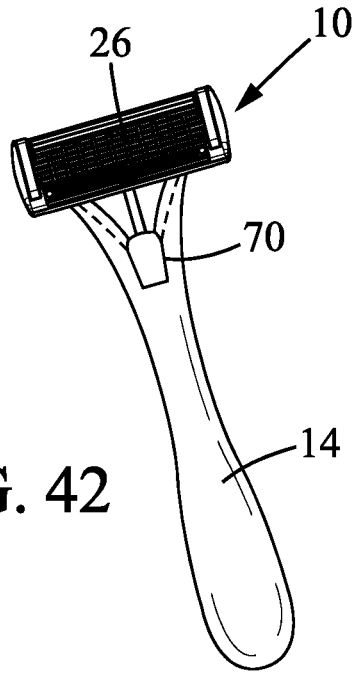

In another example, illustrated in FIGS. 26*a* and 26*b*, the masking foil 26 may be made of two materials. The masking foil 26 may actually be made of two layers of two different materials. A first layer 26*a* may face the top surface 16. A second layer 26*b* may face the bottom surface 18. The first layer 26*a* may be opposite to the second layer 26*b*. The material of the first layer 26*a* and the material of the second layer 26*b* may have different thermal expansion coefficient. When the masking foil 26 is heated, the two layers 26*a* and 26*a* may react differently. For example, the first layer 26*a* may be made of brass. The second layer 26*b* may be made of steel. When the masking foil 26 is heated, the shape of the ribbon 32 may be curved. For example, the curve can be a convex surface, according to axis Z-Z, from the bottom surface to the top surface 16. On the contrary, when the masking foil 26 is cooled, the shape of the ribbon 32, as depicted may be concave. The heating of the masking foil can be provided for example by soaking the shaving cartridge 10 in warm water. In another example, depicted in FIG. 42, the shaving razor 10 may be provided with heating means 70, such as a heat resistance connected to a battery. The cooling of the masking foil can be provided for example by soaking the shaving cartridge 10 in cold water. In all of the above-mentioned examples, the cutting edges 15 may follow the shape of the masking foil and each cutting edge may have different exposure between −200 μm to +200 μm. In addition, all of the above-mentioned examples may also allow the user to select a desired blade geometry thereby improving hair removal. Alternatively, when current can go through the masking foil 26, temperature difference may be created between the two layers. For example, the first layer 26*a* may absorb heat and may become cold, while the second layer 26*b* may expel heat and may become warm. In such example, the blade(s) may become warm while the upper surface of the ribbon(s) 32 may become cold, improving fluidity and hair removal.

In another example, not shown in figures, when the masking foil 26 can act as a blade retainer 36, the ribbon(s)

32 of the masking foil 26 may be made of a first material while the bent portions 29, 30 may be made of a second material. When current can go through the masking foil 26, temperature difference may be created between the ribbon(s) 32 and the bent portions 29, 30. For example, the first material may expel heat and may become warm, while the second material may absorb heat and may become cold. In such example, the blade(s) may become warm while the bent portions 29, 30 may become cold, improving fluidity and hair removal. In another example, the back portion 30 or the front portion 28 of the masking foil 26 can be moved upwards or downwards, manually by the user or electromechanically. For example, the masking foil 26 can be moved manually by adjusting the position of the front or back portion through a small lever-button that can move linearly or it can rotate. The masking foil may also be moved electromechanically by pressing a button on the handle, a motor activates that rotates a cam. The cam follower that may be attached on the foil determines the vertical position of the foil. The new positions can be pre-determined at specific levels. In addition, the blade edges may follow the shape of the foil, each cutting edge may have different exposure, between −200 μm to +200 μm.

Figure 27:
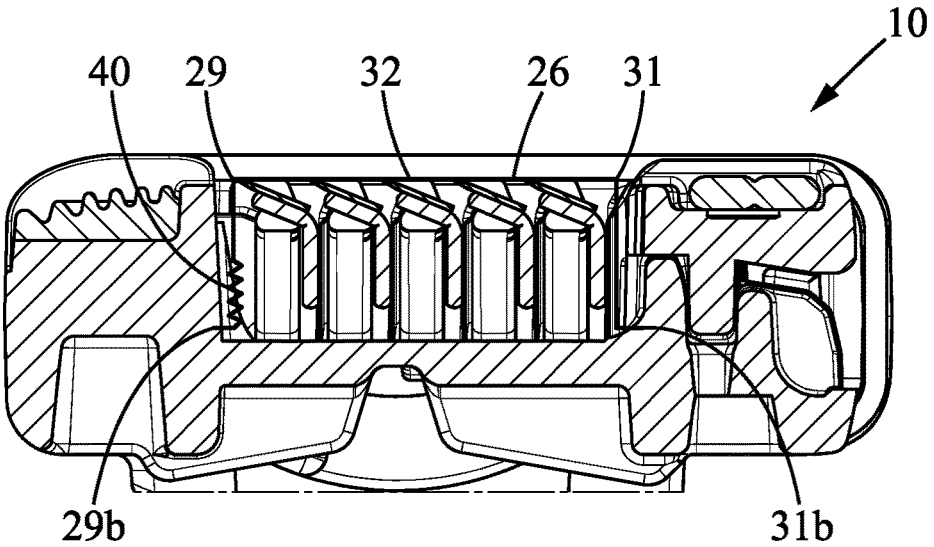

In another example, illustrated in FIG. 27, an elastic means 40 may be provided on one side of a ribbon 32, and not on the other side of the ribbon. For example, an elastic means 40 may be provided on the masking foil 26 between the front bent portion 29 and the anchorage area 29*b* and not between the back bent portion 31 and the anchorage area 31*b*. In such example, the masking foil 26 can follow the skin contours, improving hair removal and may also improve rinsability of the shaving cartridge.

In another example, illustrated in FIG. 28, the masking foil 26 may include an inner channel. The ribbons 32 may include several openings 54. The openings 54 may communicate with the inner channel. The inner channel may be connected to a generator 68. Actually, the inner channel may be connected to the generator 68 via the front and back anchorage areas. The generator 68 may be for example located in the handle 14 of the shaving razor 11, as depicted in FIG. 29. Such channel may be provided in order to spray or to lubricate the surface for shaving. For example, the generator 68 may be a steam generator. The steam may be driven to the openings 54 of the masking foil 26 via the inner channel. The steam may be diffused to the surface to shave through the openings 54. In another example, the generator 68 is a lubrication or shaving aid pump. The lubrication pump may diffuse thus lubricant or shaving aid to the surface to shave. In addition, the above-mentioned examples may improve hair removal and reduce the shaving cartridge to skin friction.

In another example, the masking foil 26 can roll around the blades while shaving. More precisely, the masking foil may be wrapped around the blades. During shaving the foil may rotate around the blades (like caterpillar wheel) due to the friction between the foil and the skin. In another example, the foil may rotate around the blades, due to electrical current that passes through. In that case, the user may have the ability to adjust the rotation speed of the foil before shaving.

Figure 30A:
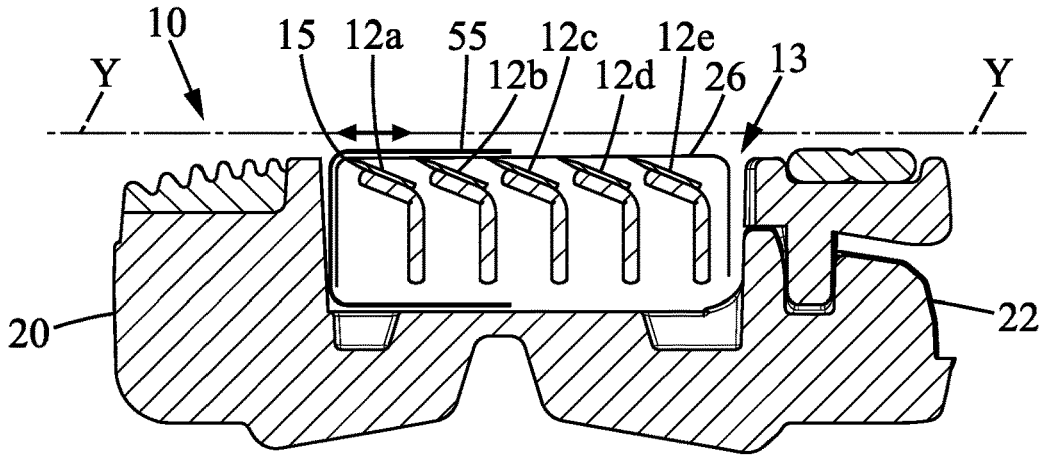
Figure 30B:
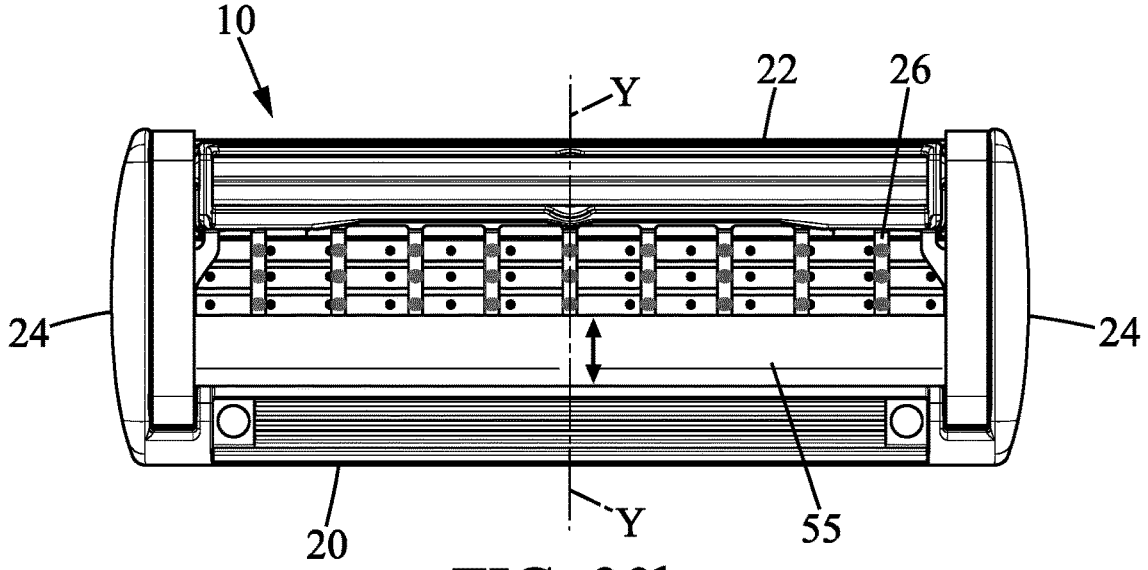

In another example, illustrated in FIGS. 30*a* and 30*b*, the masking foil 26 may include a cover 55. The cover 55 may have flexible properties. The flexibility of the cover 55 may allow the cover 55 to adapt its shape accordingly to the different elements that can surround it. For example, the cover 55 may have a U-shape in a cross-sectional view as depicted in FIG. 30. In the configuration of FIG. 30, the cover may surround the cutting edge 15 of the blade 12*a* and may be located between the anchorage area 29*a* of the masking foil 26 and the housing 13. The cover 55 may cover the front bent portion of the masking foil 26 and the cutting edge 15 of the first blade 12*a*. The cover 55 can move in the housing 13. The cover 55 may move along the transversal axis Y-Y. When moving, the cover 55 may cover the cutting edge 15 of the second blade 12*b*, in addition to the cutting edge 15 of the first blade 12*a*. The cover 55 can also cover the cutting edge of the third blade 12*c*, etc. In another example, the cover 55 may be located at the back bent portion 31 of the masking foil 26 instead of the front bent portion 29. The cover 55 may allow to deactivate the use of the hide blades 12, protect the blades 12 from humidity increasing the life of the blades 12.

Figure 31:
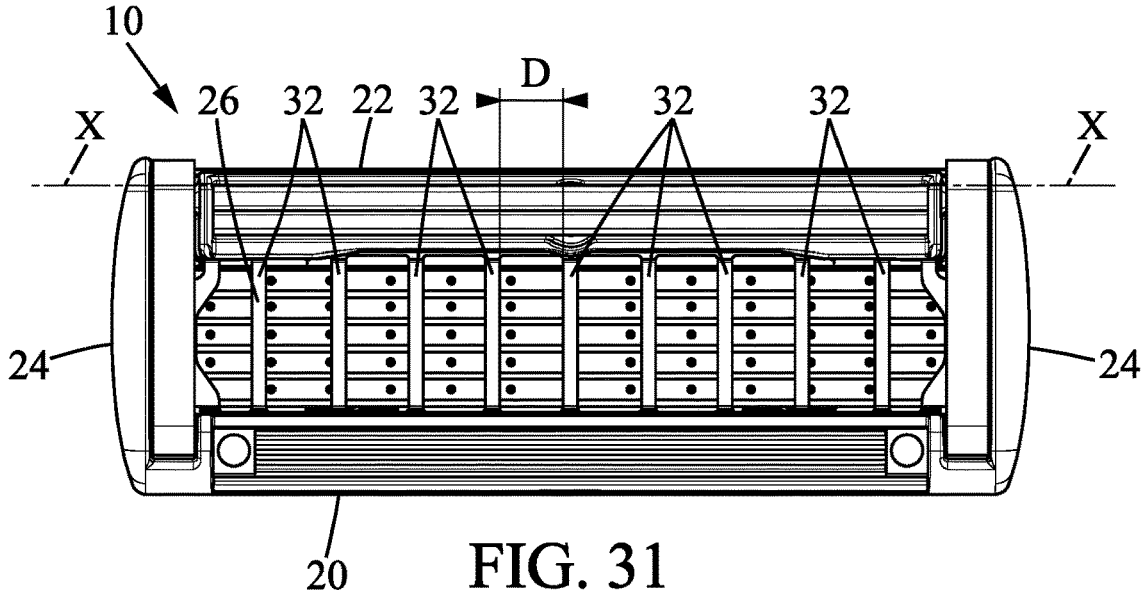

In another example, illustrated in FIG. 31, the masking foil 26 may have displacement means to set the distance D between each ribbon 32. The ribbons 32 may be movable along the axis X-X. For example, the ribbons 32 may be slidably attached to the front and back anchorage areas 29*a*, 29*b* and 31*a*, 31*b*. This masking foil 26 may reduce the shaving cartridge to skin friction, rinsability of the shaving cartridge.

Figure 32:
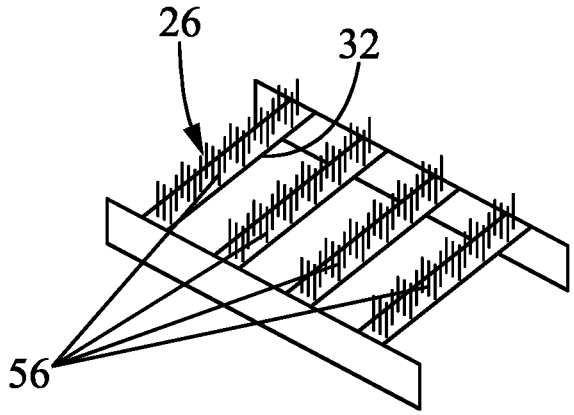

In another example, illustrated in FIG. 32, the ribbons 32 may include bristles 56. The bristles 56 may be flexible. The bristles 56 may have rounded tips. The height of the bristles 56 may be up to 0.6 mm, may be spaced at least about 0.3 mm from a next adjacent bristle 56 and may have a width defined at the respective root at least about 0.1 mm. The bristles 56 can move during shaving. The bristles 56 may face the top surface 16. The bristles 56 may provide a soft contact with the skin during shaving, a massage of the skin during shaving.

Figure 33:
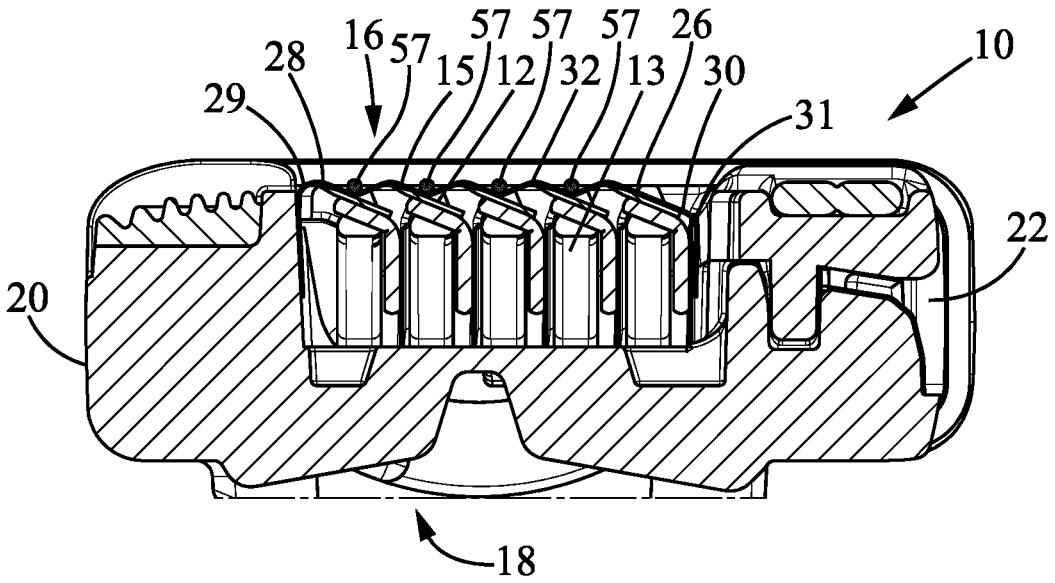

In another example, illustrated in FIG. 33, the corrugations of the masking foil, as depicted in FIG. 9*c* may include a lubricant or a shaving aid element. More precisely, the lubricant or the shaving aid element may be located on each concavity 57 of the corrugations. The height of the lubricant or the shaving aid element may be up to 1.0 mm, improving glideness of the shaving razor 10 on the skin during shaving and reducing skin bulge, nicks and cuts during shaving. When the lubricant or shaving aid element is a hydrophobic material, the rinsability of the masking foil 26 may also be improved.

Figure 34:
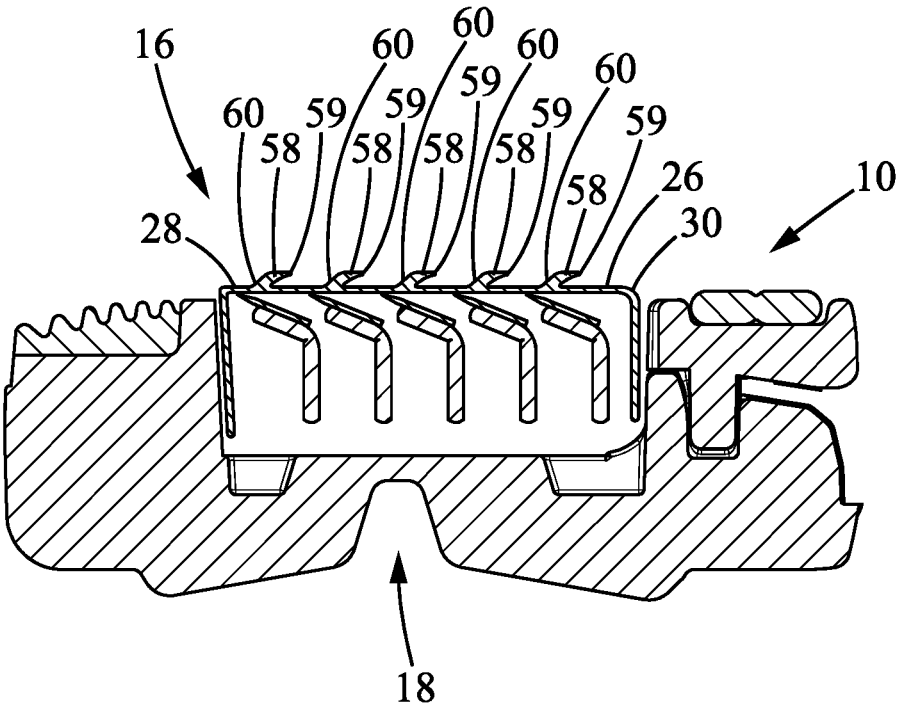

In another example, illustrated in FIG. 34, the ribbon 32 may include pikes 58 as shark fins. The tip 59 of the pikes 58 may be oriented towards the back portion of the masking foil. The pikes 58 may be oriented toward the top surface 16. The base 60 of the pikes 58 may be oriented towards the front portion 28 of the masking foil 26. The height of pikes 58 may be up to 0.6 mm. The pikes 58 may provide a mechanical exfoliation of the skin, as a pre-shave skin preparation phase. In addition, the pikes 58 may provide a dermo-dynamic feature, improving glideness of the shaving razor 10 on the skin during shaving.

In another example, the masking foil 26 may have an organic pattern. The organic pattern may follow the skin contours and guide the hair smoothly, providing a better hair alignment, smoother shaving and better hair removal.

Figure 35:
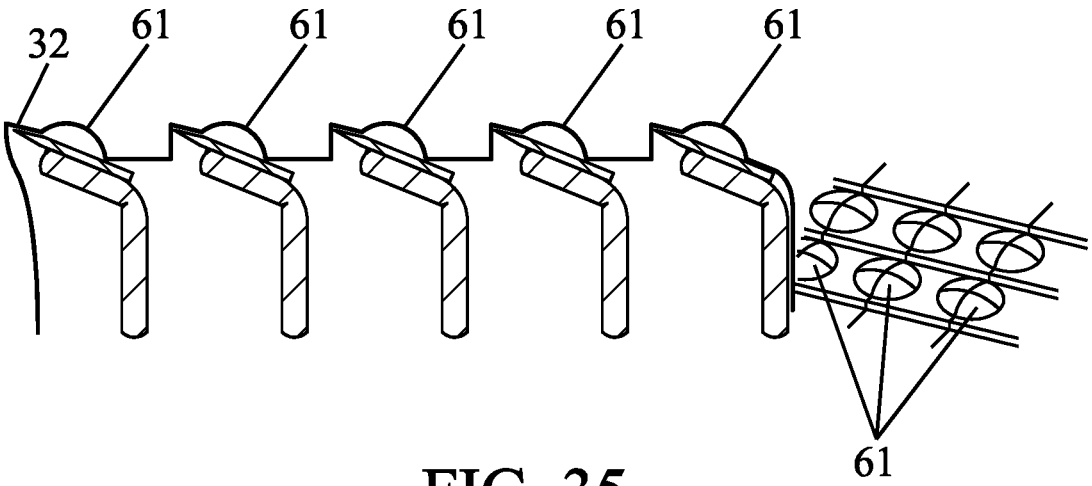

In another example, illustrated in FIG. 35, the ribbons 32 may include sphere shaped protrusions 61. The sphere shaped protrusions 61 may face toward the top surface 16. The height of the sphere shaped protrusions 61 may be up to 0.6 mm. The sphere shaped protrusions 61 may provide a massage of the skin during shaving.

Figure 36:
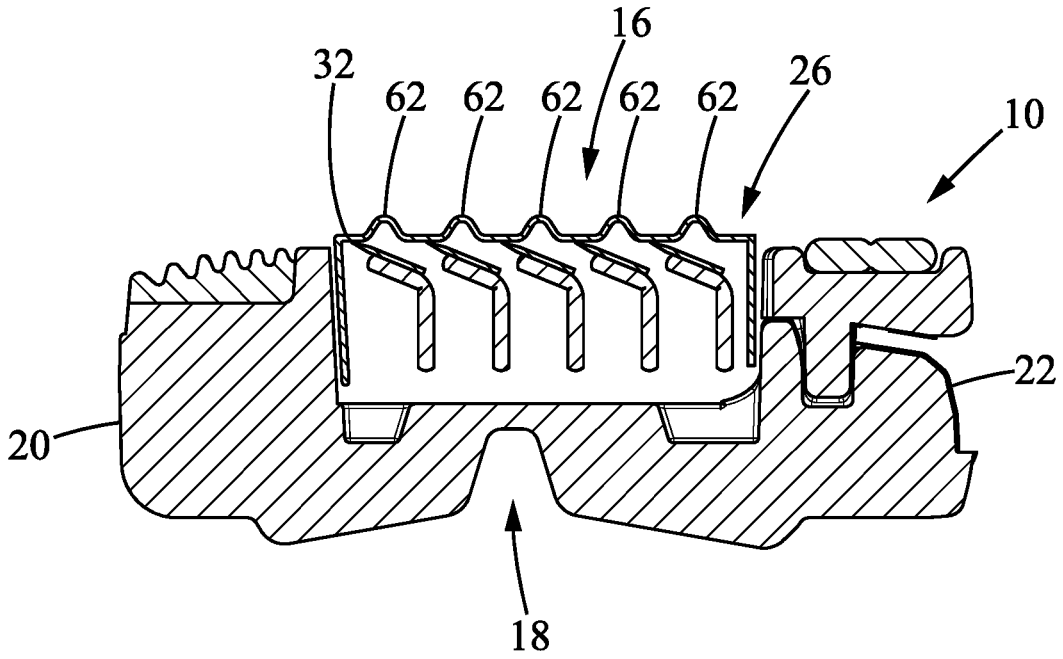

In another example, illustrated in FIG. 36, the ribbons 32 may include rounded protrusions 62. The rounded protrusions 62 may face toward the top surface 16. The height of the rounded protrusions 62 may be up to 0.6 mm. The rounded protrusions 62 may eliminate the bulging effect that may happen during the shaving.

In another example, when the masking foil 26 is not fixedly mounted in the housing and does not cover partially the cutting edge 15 of all the blades 12, for example as illustrated in FIG. 6, the blades 12 that are uncovered by the masking foil 26 can be movable, or fixedly mounted in the housing 13. Moreover, each cutting edge 15 may have different exposure, between −200 μm to +200 μm. In addition, the masking foil 26 may improve hair removal and reduce nicks and cuts during shaving.

Figure 37:
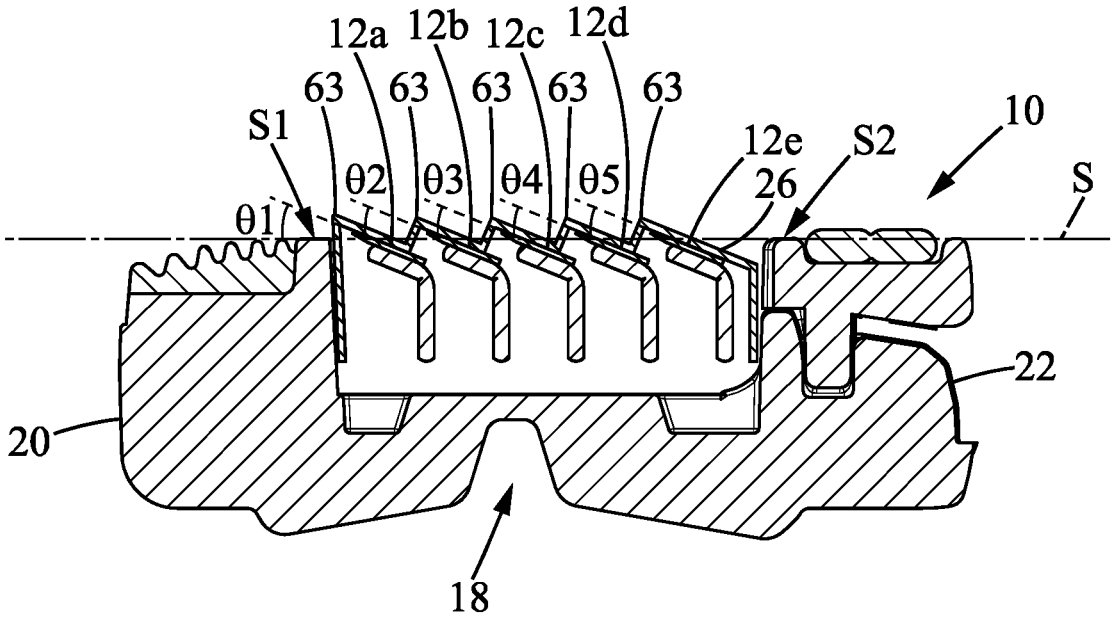
Figure 38:
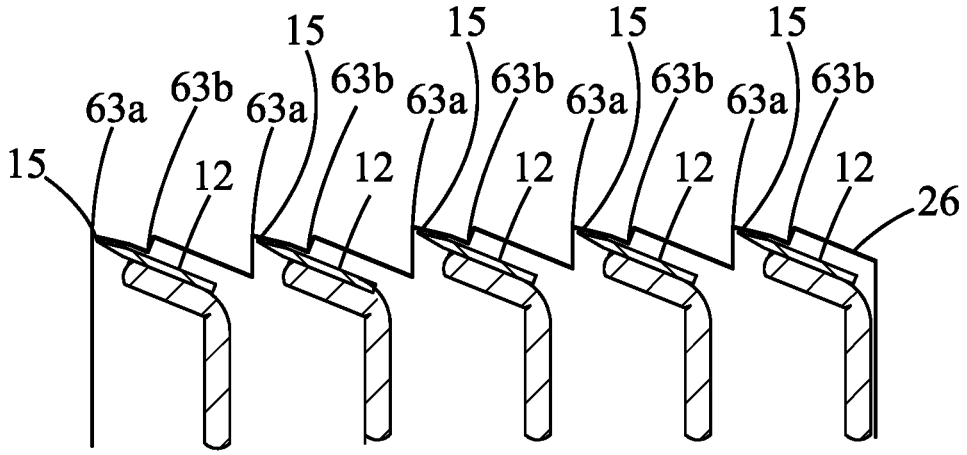

In another example, illustrated in FIG. 37, the shape surface of the masking foil 26 may be corrugated. The tip 63 of each corrugation may be sharp. Each corrugation 63 can be used for stabilizing and regulating the angle of each blade 12. The angle (also called shaving angle) may be the angle between the upper surface of the blade 12 and the shaving plane S at rest position (non-shaving). The shaving angle may be between 5° and 30°. The shaving angle of each blade may be the same, totally different, progressive or any combination thereof. For example, when the shaving cartridge 10 includes five blades, the shaving angle θ1 of the first blade 12*a* may be smaller than the shaving angle θ2 of the second blade 12*b*. Likewise, the shaving angle θ2 of the second blade 12*b* may be smaller than the shaving angle θ3 of the third blade 12*c*. The shaving angle θ3 of the third blade 12*c* may be smaller than the shaving angle θ4 of the fourth blade 12*d*. The shaving angle θ4 of the fourth blade 12*d* may be smaller than the blade angle thickness of the fifth blade 12*e*. In another example, illustrated in FIG. 38, each corrugation may include two tips 63. The first tip 63*a* may correspond to the cutting edge 15 of the blade 12 located below. The second tip 63*b* may correspond to an additional tip located above the blade 12. This masking foil 26 may reduce the total number of strokes during shaving.

Figure 39:
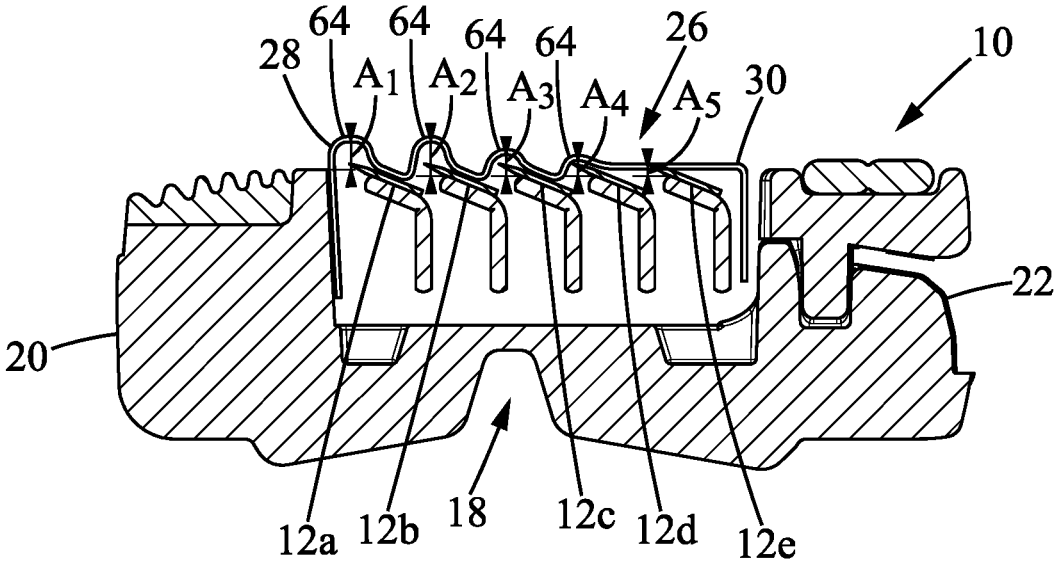

In another example, illustrated in FIG. 39, the shape surface of the masking foil 26 may be corrugated. The corrugations 64 may be located on the side of the front portion 28 of the masking foil 26. In further aspects, the corrugations 64 may be dispersed in another part or in the whole surface of the masking foil 26. Actually, each corrugation 64 may have an amplitude different from each other. The amplitude may be up to 0.6 mm. For example, the amplitude A1 of the corrugation 64 of the first blade 12*a* may be larger than the amplitude A2 of the corrugation 64 of the second blade 12*b*. Likewise, the amplitude A2 of the corrugation 64 of the second blade 12*b* may be larger than the amplitude A3 of the corrugation 64 of the third blade 12*c*. The amplitude A3 of the corrugation 64 of the third blade 12*c* may be larger than the amplitude A4 of the corrugation 64 of the fourth blade 12*d*. The amplitude A4 of the corrugation 64 of the fourth blade 12*d* may be larger than the amplitude A5 of the corrugation 64 of the fifth blade 12*e*. In the example depicted, the amplitude A5 may be null. In another example, each corrugation 64 may press each blade differently. Each blade 12 may have different or a progressive exposure, between −200 μm to +200 μm. For example, the first corrugation 64 of the first blade 12*a* may press the first blade 12*a* creating a negative geometry. Simultaneously, the second corrugation 64 of the second blade 12*b* may press the second blade 12*b* a little bit lower than the first and so on, till the fifth blade 12*e*. In another example, the masking foil 26 may not include corrugations 64 above the forth blade 12*d* and/or the fifth blade 12*e*. In this example, the masking foil may not press the forth 12*d* and/or the fifth blade 12*e*. The forth 12*d* and/or the fifth blade 12*e* may have different geometry than the first blade 12*a*, second blade 12*b* and the third blade 12*c*. The corrugations 64 may reduce the shaving cartridge to skin friction, reduce skin bulge and improve hair alignment during shaving.

Figure 40:
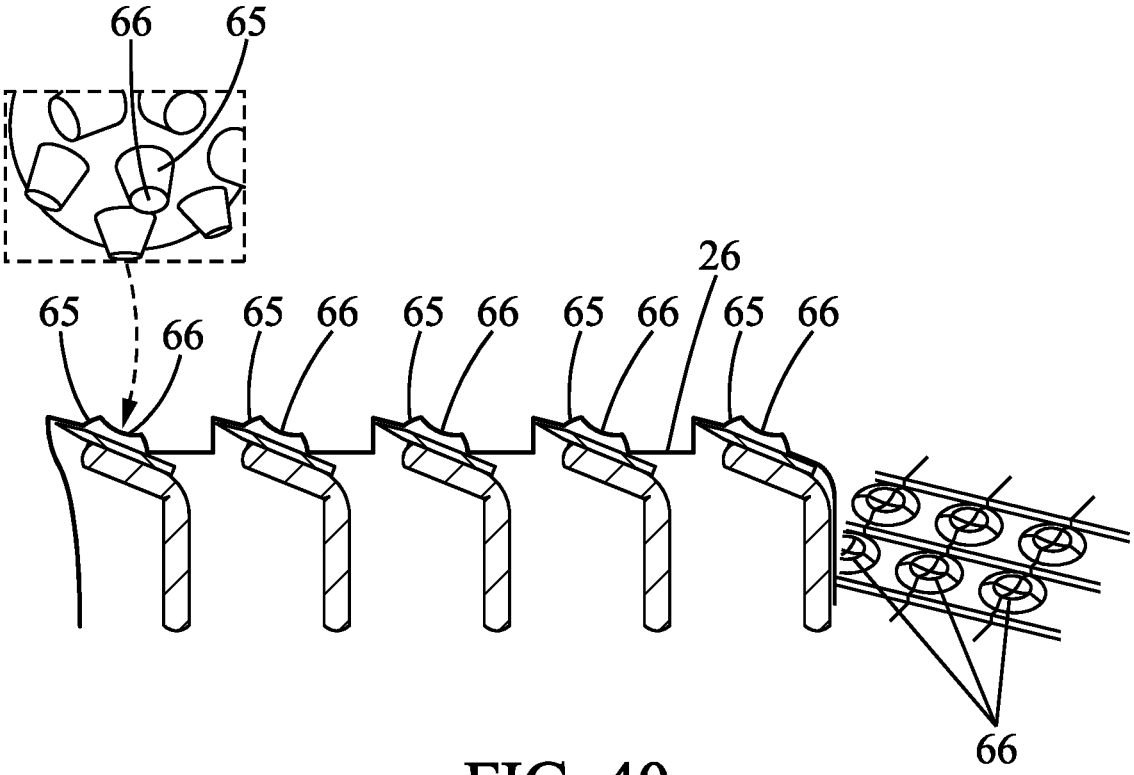

In another example, illustrated in FIG. 40, the ribbons 32 may include extruded protrusions 65. The extruded protrusions may have a rectangular or a conical shape. The conical shape ends with an aperture 66. The extruded protrusions 65 may face toward the top surface 16. The extruded protrusions 65 may include lubricant or shaving aid, which may be stored in the apertures 66. In addition, an electrical current can go through the masking foil 26, the extruded protrusions 65 may be heated and the release rate of the lubricant or shaving aid may be increased. In another example, the extruded protrusions 65 may be covered by a polymer film. An electrical current can go through the masking foil 26, the electrical current may control the porosity of the polymer film, the pores of the polymer film may expand and the release rate of the lubricant or the shaving aid from the apertures 66 may be increased. All of the above-mentioned examples may improve hair removal and reduce nicks and cuts and irritations during shaving.

Figure 41:
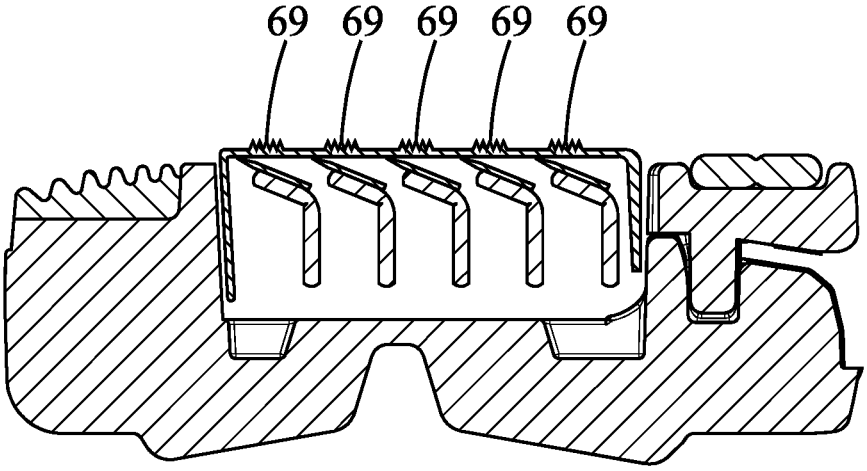

In another example, illustrated in FIG. 41, the ribbons 32 may include small barbs. The small barbs may be split into clumps 69 along the ribbon 32. The height of the clumps 69 may be up to 0.6 mm and the distance between two adjacent clumps 69 may be more that 0.1 mm. The small barbs may provide a mechanical exfoliation of the skin. For example, the mechanical exfoliation may be a sebum removal.

Figure 43:
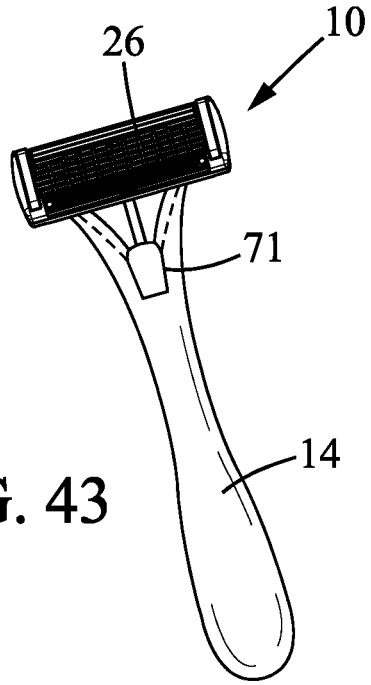

In another example, illustrated in FIG. 43, the handle and the cartridge may include a vibrating means 71. The vibrating means 71 may be connected to the masking foil 26.

A masking foil 26 for a shaving cartridge (10), as shown in FIG. 3, can be made by using several methods, such as photo etching, laser cutting, stamping, electrical discharge machining, water jet cutting or electroforming. For example, the masking foil can be made of a flat strip of material. The strip may have an upper portion and a lower portion. The material is chosen among plastic material, composite, aluminum, aluminum alloys and/or noble metals chosen among gold or platinum. The strip material may pass through a stamping station performing holes in the strip, forming the pattern of the masking foil 26, as shown for example in FIG. 10*a*. After the stamping station, the masking foil 26 may pass through a bending station. The bending station may include a slot which receives the strip. The upper portion and the lower portion of the strip project outside of the slot. The upper portion and the lower portion may be bent inwardly about a bending axis, forming a front bent portion 29 and a back bent portion 31 of the masking foil. The front bent portion 29 and the back bent portion 31 of the masking foil 26 may have the same or different radius of curvature. The radius of curvature can be range between 0.10 mm to 0.70 mm. In another example, an elastic means 40 may be formed between the front bent portion 29 and the anchorage area 29*b* of the masking foil 26 as visible in FIGS. 10*a* and 10*b*. The elastic means 40 can for example be a spring. An elastic means 40 can also be formed between the back bent portion 31 and the anchorage area 31*b*. In another example, the lower portion of each anchorage area 29*b*, 31*b* may be bent outwardly forming a portion which may fit into each slot 13*a*, 13*b*, as shown in FIGS. 10*b* and 10*c*. In another example, the side edges of each ribbon 32 may be grinded or electrochemically etched, providing additional cutting edges of different profiles as shown in FIGS. 19, 20.

The invention claimed is:

1. A shaving cartridge comprising:

a housing, at least one masking foil, and at least one retainer;

the housing including a top surface, a bottom surface, a front edge, a rear edge, and a pair of side edges extending between the front edge and the rear edge; and a first blade disposed between the front edge and the rear edge of the housing, the first blade having a first cutting edge extending toward the top surface of the housing, the first blade being movable in the housing;

the at least one masking foil including a lubricating coating, a front portion located forward of the first cutting edge of the first blade, a back portion located rearward of the first cutting edge of the first blade, a first securing portion connecting first ends of the front and back portions and a second securing portion connecting second ends of the front and back portions, and at least one ribbon extending between the front portion and the back portion and partially covering the first cutting edge of the first blade; and the at least one masking foil is inserted in the housing of the cartridge and the first and second securing portions are disposed between the first blade and the at least one retainer to secure the first blade within the housing.

2. The shaving cartridge according to claim 1, wherein the at least one ribbon further includes a front bent portion connected to the front portion of the at least one masking foil and being directed toward the bottom surface of the housing, and a back bent portion connected to the back portion of the at least one masking foil and being directed toward the bottom surface of the housing.

3. The shaving cartridge according to claim 2, wherein the masking foil further includes at least two elastic portions, each of the at least two elastic portions including a first end, the first end of each of the least two elastic portions being connected to and extending from, respectively, the front bent portion and the back bent portion of the at least one ribbon, in a direction away from the top surface of the housing.

4. The shaving cartridge according to claim 1, further including a second blade, the second blade having a second cutting edge, the at least one ribbon partially covering both the first cutting edge and the second cutting edge, and wherein the first and second securing portions are disposed adjacent to both the first cutting edge of the first blade and the second cutting edge of the second blade.

5. The shaving cartridge according to claim 1, further including a second blade, the second blade having a second cutting edge, wherein the at least one ribbon partially covers the first cutting edge and the second cutting edge is uncovered by the at least one ribbon.

6. The shaving cartridge according to claim 1, wherein the first and second securing portions are fixedly mounted, respectively, in each one of the pair side edges of the housing of the shaving cartridge.

7. The shaving cartridge according to claim 3, wherein a second end of each of the at least two elastic portions are connected, respectively, to a front anchorage area and a back anchorage area; the front anchorage area extending away from the front edge of the housing and the back anchorage area extending away from the rear edge of the housing.

8. The shaving cartridge according to claim 7, wherein the at least two elastic portions are located, respectively, between the front and back anchorage areas and the front and back bent portions of the at least one ribbon.

9. The shaving cartridge according to claim 7, wherein the front and back anchorage areas are fixed in the housing adjacent the front and rear edges, respectively.

10. The shaving cartridge according to claim 1, wherein the at least one ribbon covers between 1% and 70% of the first cutting edge of the first cutting blade.

11. The shaving cartridge according to claim 1, wherein the at least one ribbon is planar in shape.

12. The shaving cartridge according to claim 1, wherein the at least one ribbon is disposed about the first cutting edge of the first cutting blade at an angle of between 15° and 90°.

13. The shaving cartridge according to claim 4, wherein the at least one ribbon is disposed about the first cutting edge of the first blade and the second cutting edge of the second blade at an angle of between 15° and 90°.

14. A masking foil for a shaving cartridge according to claim 1, wherein the masking foil is manufactured comprising the steps of: a) providing a flat strip of material, b) forming holes in the flat strip of material, and c) forming a pattern on the flat strip of material.

15. A shaving cartridge comprising:

a housing, at least one masking foil, and at least one retainer;

the housing including a top surface, a bottom surface, a front edge, a rear edge, and a pair of side edges extending between the front edge and the rear edge; and a first blade disposed between the front edge and the rear edge of the housing, the first blade having a first cutting edge extending toward the top surface of the housing, the first blade being movable in the housing;

the at least one masking foil including a front portion located forward of the first cutting edge of the first blade, a back portion located rearward of the first cutting edge of the first blade, a first securing portion connecting first ends of the front and back portions and a second securing portion connecting second ends of the front and back portions, and at least one ribbon extending between the front portion and the back portion and partially covering the first cutting edge of the first blade; and the at least one masking foil is inserted in the housing of the cartridge and the first and second securing portions are disposed between the first blade and the at least one retainer to secure the first blade within the housing, wherein the at least one ribbon further includes a front bent portion connected to the front portion of the at least one masking foil and being directed toward the bottom surface of the housing, and a back bent portion connected to the back portion of the at least one masking foil and being directed toward the bottom surface of the housing, and wherein the masking foil further includes at least two elastic portions, each of the at least two elastic portions including a first end, the first end of each of the least two elastic portions being connected to and extending from, respectively, the front bent portion and the back bent portion of the at least one ribbon, in a direction away from the top surface of the housing.

16. The shaving cartridge according to claim 15, wherein a second end of each of the at least two elastic portions are connected, respectively, to a front anchorage area and a back anchorage area; the front anchorage area extending away from the front edge of the housing and the back anchorage area extending away from the rear edge of the housing.

17. The shaving cartridge according to claim 16, wherein the at least two elastic portions are located, respectively, between the front and back anchorage areas and the front and back bent portions of the at least one ribbon.

18. The shaving cartridge according to claim 16, wherein the front and back anchorage areas are fixed in the housing adjacent the front and rear edges, respectively.

19. The shaving cartridge according to claim 15, wherein the at least one ribbon is planar in shape.

20. The shaving cartridge according to claim 15, further including a second blade, the second blade having a second cutting edge, the at least one ribbon partially covering both the first cutting edge and the second cutting edge, and wherein the first and second securing portions are disposed adjacent to both the first cutting edge of the first blade and the second cutting edge of the second blade.

* * * * *